US005657004A

United States Patent [19]

Whittaker et al.

[11] Patent Number: 5,657,004

[45] Date of Patent: Aug. 12, 1997

[54] ELECTRONICALLY CONTROLLED POINT OF PURCHASE DISPLAY

[75] Inventors: Dennis R. Whittaker, South Bend; Gordon J. Waligorski, Delphi, both of Ind.

[73] Assignee: Felknor International, Inc., Monon, Ind.

[21] Appl. No.: 420,103

[22] Filed: Apr. 11, 1995

[51] Int. Cl.[6] ..... G08B 5/22; G08B 25/08

[52] U.S. Cl. ..... 340/815.45; 340/815.46; 340/815.47; 340/815.49; 340/815.73; 340/692; 340/525; 340/691

[58] Field of Search ..... 340/815.45, 815.46, 340/815.47, 815.49, 815.73, 691, 692, 693, 525, 326, 384.1; 40/427, 441, 541, 564

[56] References Cited

U.S. PATENT DOCUMENTS

| | | | |
|---|---|---|---|
| 2,358,629 | 11/1955 | Carter | 73/200 |
| 3,088,996 | 5/1963 | Carter | 369/70 |
| 3,459,961 | 8/1969 | Ravas | 307/116 |
| 4,035,941 | 7/1977 | Deffner | 40/219 |
| 4,277,904 | 7/1981 | Leuthesser | 40/564 |
| 4,553,344 | 11/1985 | Rubin et al. | 40/735 |
| 4,639,725 | 1/1987 | Franke | 340/815.4 |
| 4,670,798 | 6/1987 | Campbell et al. | 360/12 |
| 4,835,661 | 5/1989 | Fogelberg et al. | 362/97 |
| 4,853,678 | 8/1989 | Bishop, Jr. et al. | 340/573 |
| 4,912,457 | 3/1990 | Ladd | 340/573 |
| 4,922,384 | 5/1990 | Torrence | 362/31 |
| 4,934,079 | 6/1990 | Hoshi | 40/427 |
| 4,951,045 | 8/1990 | Knapp et al. | 340/944 |
| 4,954,813 | 9/1990 | August, Sr. et al. | 340/571 |
| 4,984,098 | 1/1991 | Buntsis | 360/12 |
| 4,990,092 | 2/1991 | Cummings | 434/317 |
| 5,003,293 | 3/1991 | Wu | 340/573 |
| 5,111,606 | 5/1992 | Reynolds | 40/642 |
| 5,182,872 | 2/1993 | Lee et al. | 40/717 |
| 5,190,307 | 3/1993 | Brown et al. | 280/271 |
| 5,275,285 | 1/1994 | Clegg | 206/449 |
| 5,304,084 | 4/1994 | Liao | 446/9 |
| 5,305,197 | 4/1994 | Axler et al. | 364/405 |
| 5,315,285 | 5/1994 | Nykerk | 340/426 |

*Primary Examiner*—Donnie L. Crosland
*Attorney, Agent, or Firm*—Bose McKinney & Evans

[57] ABSTRACT

An electronic display device renders both an audio message and a visual message. The display device includes a housing, including a frame for holding at least a first and second non-overlapping transparency which contains a visual message, a front panel which contains a viewing aperture for receiving the frame, and a back panel member. Each of the front panel and back panel include an array of peripheral al, spaced apertures through which a fastening device, such as a bolt, can be passed for securing together the front panel member to the back panel member, and sandwiching the frame therebetween. The device also includes a first and second light source for illuminating, respectively, the first transparency and the second transparency. A direct analog audio storage chip is provided for playing an audio message having at least a plurality of audio segments. A sensor, such as a pryoelectric IR motion sensor, is provided for sensing the presence of a person in the vicinity of the device. A controller is provided for controlling the operation of the first and second light sources, and the direct analog audio storage chip, to begin playing a multi-segmented audio message, and to begin illuminating, selectively, the plurality of transparencies, in a sequential manner, to provide a message to a viewer. The operation of the controller, light sources, and analog audio chip are performed in response to the sensing, by the sensor, of the presence of a person in the vicinity of the display device.

23 Claims, 12 Drawing Sheets

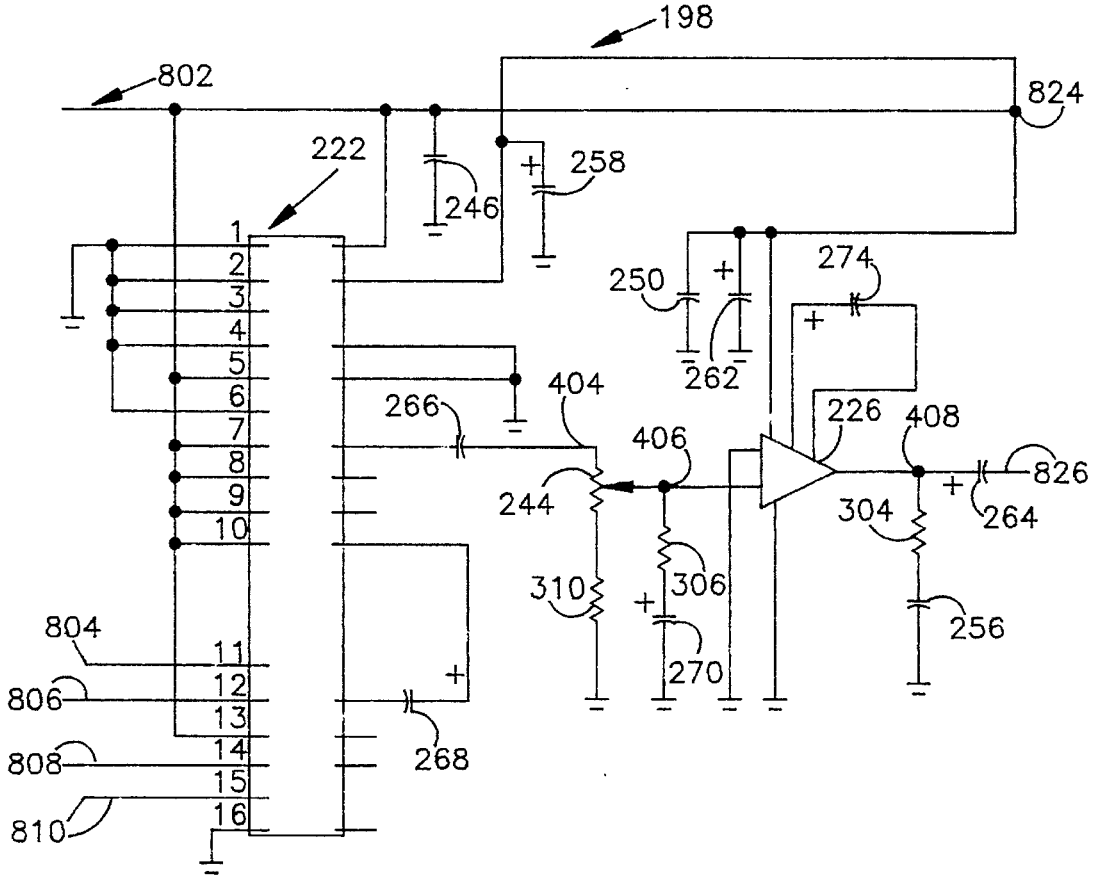
A8 & A9 HIGH SETS UP OPERATIONAL MODE
FIG. 9B
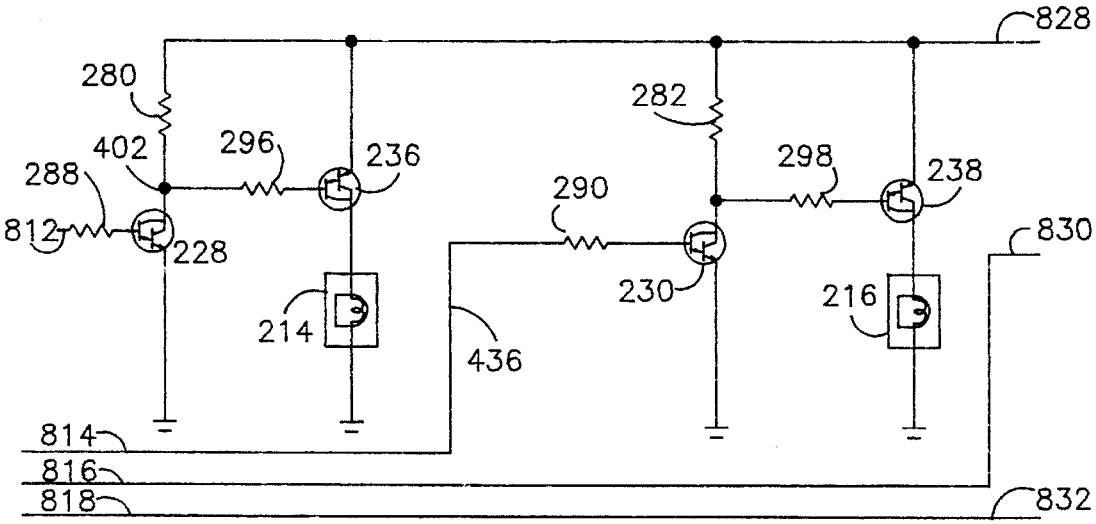

ELECTRONICALLY CONTROLLED POINT OF PURCHASE DISPLAY

I. TECHNICAL FIELD OF THE INVENTION

The present invention relates to advertising and display devices, and more particularly, to an electronically controlled point of purchase display for use in conveying both an electronic and a visual message to a recipient.

II. BACKGROUND

Purveyors of products have long sought ways to advertise their products in a manner that will cause prospective purchasers to purchase their products. One key to successful advertising is to grab the attention of the prospective purchaser. Another key is to convey information about the product to the purchaser in a manner that generates sufficient interest to cause a favorable purchasing decision.

It has long been known that an advertisement's impact can be enhanced if a vehicle is provided that is capable of conveying the message through more than a single medium, such as more than just sound, or more than just a visual display. To that end, commercial television advertisements have been particularly successful advertising devices because they combine both an audio and visual message about the advertised product.

However, one drawback with television commercials is that the place at which a prospective purchaser receives a television commercial is often remote from the place at which the purchaser can buy the advertised product. Because of this reason, many manufacturers and retailers have found that advertisements placed at the point of purchase can be particularly successful. Such point of purchase advertising traditionally takes the form of attractive packaging, shelf signs and stand-up displays.

Recently, many retailers have introduced the use of television sets placed at various points within a retail store that play video-taped messages about a particular product or set of products. These television systems often use a central playback unit to broadcast a taped message to a plurality of television sets located throughout a retail establishment. Alternately, video tape player containing television sets can be placed adjacent to the particular product or products shown in the messages. With such situations, each television set can play a different message directed to the particular product placed adjacent to the television set.

It will also be appreciated that such message conveying devices have applicability outside of a retail or trade show environment. For example, many museums are capable of enhancing their patrons' appreciation of the items displayed in the museum by placing a plurality of message conveying devices in different parts of the museum. Preferably, the message conveying devices each convey a different message, tailored to the particular display items that are placed adjacent to the particular message conveying device. For example, many museums contain video tape playing television sets that are placed adjacent to certain displays for conveying additional information to the viewer about the displayed item.

As will be appreciated, many of the same concerns that govern the design of a point of purchase display device also govern the design of a device for conveying message at a museum. As a general rule, message conveying devices should be durable, user friendly, and convey a message that will be sufficiently attractive to the person viewing the message to capture the viewer's attention long enough to cause him to hear the entire message conveyed.

Several devices exist for conveying a message at the point of purchase or point of display.

Buntsis U.S. Pat. No. 4,984,098 discloses a point of purchase advertising device that generates a prerecorded audio message automatically whenever a person is nearby, and which resets itself automatically to prepare for the presence of another person. The device causes a tape recorder to begin playing an audio message when the presence of a person is sensed by a motion detector. The motion detector is then disabled for the duration of the audio message being played back by the tape recorder, plus an additional time period governed by a timer.

Campbell, et al. U.S. Pat. No. 4,670,798 relates to a point of purchase advertising system that senses the presence of a person in the vicinity of an advertising display, and thereupon renders an appropriate advertisement, such as a recorded verbal message, or a visual or audio demonstration. The device can include an ultrasonic sensing circuit for detecting the approach of a potential customer, an endless tape playback unit for playing the advertisement, and a controller for operating the playback unit in response to the detection of a customer.

Reynolds U.S. Pat. No. 5,116,606 discloses a lighted, shelf merchandising display that includes a frame having an array of lights thereon for capturing a user's attention. The frame is designed for holding a pair of signs in a back-to-back relation. A bracket is provided for coupling the frame to a shelf unit, such as a grocery store shelf.

Torrence U.S. Pat. No. 4,922,384 discloses a display that uses at least a pair of aligned mirrors (one of which is a "half-silvered" mirror) to produce multiple images of a product being displayed, or to create an image of the product being displayed which is surrounded by flashing lights. The multiple images and the flashing lights are believed by Torrence to be useful in attracting the attention of a potential customer.

Carter U.S. Pat. No. 3,088,996 relates to a display device that includes a plurality (e.g., six) individual pictures or transparencies which are sequentially illuminated by six lamps. A tape recorder mechanism having prerecorded sound or narration portions for each picture to be displayed is combined with the display panel, so that the lighting and corresponding sound portion are always in synchronization under the control of the circuit which controls the device.

Fogelberg, et al. U.S. Pat. No. 4,835,661 discloses a display stand having a housing for holding a flat display screen, and a curvilinear, light diffusing rear wall. The light diffusing rear wall has a curvilinear shape so that it evenly diffuses the light onto the screen, both at the bottom and at the top of the screen.

Leuthesser U.S. Pat. No. 4,277,904 discloses a display box having a display stand that is lighted by lights contained within a housing panel.

Carter U.S. Pat. No. 2,858,629 discloses a collapsible knock-down display that will hold a plurality of pictures such as photographic transparencies.

One of the features found in many of the devices discussed above is a means for sensing the presence of a person in the area adjacent to the machine, and a control means for selectively actuating the device to begin delivering a message when such a person is sensed.

In addition to the various presence detector mechanisms disclosed in the patents discussed above, another presence detector is disclosed in Ravas U.S. Pat. No. 3,459,961. Ravas discloses a device for controlling the application of power to a load in response to the movement of an object within a prescribed area. Ravas' device includes a transmitter for generating and radiating a sound wave having a substantially constant carder frequency. A receiver for receiving the sound wave and for producing an output signal in response thereto is also included along with a detector circuit that is connected to produce an output signal in response to doppler shifts in the frequency of the received sound wave caused by the object's movement. A timed delay circuit is provided which is connected to produce a switching voltage in response to the detector circuit output signal, and to remove the switching voltage at a pre-determined time after cessation of the movement causing the doppler shift. A switching circuit is connected to apply and remove power to the load in respective response to the production and removal of the switching voltage.

Although many of the devices disclosed above very likely perform their intended functions in a workmanlike manner, room for improvement exists. For example, many of the devices disclosed above are limited to conveying a message in a single medium, such as through only sound, or only through sight. Others of the devices suffer the drawback of requiring the use of various electro-mechanical devices, such as playback tape recorders and electromechanical controllers, which are often unreliable and subject to breakdown and wear out. Additionally, such electromechanical devices often are difficult to program, and cause the user difficulty in trying to coordinate the audio message with the visual display given by the device.

It is therefore one object of the present invention to provide a device which provides an audio display that is coordinated with a changing visual display, that is easy to use, easy to program, and reliable in operation. Additionally, it is a further object of the present invention to provide such a display that will render a message to a consumer in a manner that will attract and hold his attention, and convey a substantial amount of information to the viewer.

III. SUMMARY OF THE INVENTION

In accordance with the present invention, an electronic display device is provided for rendering both an audio message and a visual message. The display device comprises a housing means which includes a frame means for holding at least first and second generally non-overlapping transparencies that contain a visual message. A first light source is provided for illuminating the first transparency, and a second light source is provided for illuminating the second transparency. A direct analog audio storage chip is provided for playing an audio message having at least a first audio segment and a second audio segment. A sensor means is provided for sensing the presence of a person in the vicinity of the device, and a controller means as provided for controlling the operation of the first and second light sources, the direct analog audio storage chip, and the sensor means.

Preferably, the controller means includes means for receiving a signal from the sensor means in response to the detection, by the sensor means, of a person in the vicinity of the device. The controller means also includes means for actuating both of the first light source to begin illuminating the first transparency, and the audio storage chip to begin playback of the first audio segment in response to the reception of the signal from the sensor means. The controller includes means for receiving an end of segment signal from the audio storage chip that indicates the end of the first audio segment. The controller means further includes means for deactivating both the first light source to stop illuminating the first transparency, and the audio storage chip to stop playback of the first audio segment, in response to the reception of the end-of-segment signal from the audio storage chip. Additionally, the controller includes means for actuating both of the second light source to begin illuminating the second transparency, and the audio storage chip to begin playback of the second audio segment in response to the deactivation of the first light source, and the first segment of the audio storage chip.

In a preferred embodiment, the direct analog audio storage chip has at least a Number, "N" of audio segments, wherein N is at least four audio segments, and the controller includes means for receiving an end of segment signal from the audio storage chip indicating the end of the Nth audio segment, and for deactivating both of the light source then illuminated, and the audio storage chip to stop playback of the Nth audio segment. The controller further includes means for placing the device in a stand-by state of readiness for awaiting another signal from the sensor means indicating the presence of a person in the vicinity of the device.

Additionally, the housing means for the device can include a front panel member having a viewing aperture alignable with the transparencies of the frame means, and a plurality of spaced peripheral apertures. The housing can further include a back panel means which also includes a plurality of spaced apertures alignable with the apertures of the front panel means. The frame means can include a plurality of spaced peripheral apertures alignable with the space peripheral apertures of each of the front panel member and rear panel member. A plurality of fastening means are provided for passing through the aligned peripheral apertures of the front panel member and back panel member for fastening together the front panel member, and back panel member and sandwiching the frame means between the front panel member and back panel member.

Also, in one embodiment of the present invention, the sensor can be replaced with a push button type manual activator to permit the user to manually start the display/talk sequence.

One feature of the present invention is that it employs a direct analog storage chip type for holding and playing back the audio message. The feature has several advantages. First, a direct analog storage chip functions similarly to an integrated circuit, in that its operation is totally electronic, and not electromechanical like a tape recorder. This feature has the advantage of providing an audio playback device that contains no moving parts, such as capstans, motors, and spindles that can wear out through the passage of time and use. Further, the direct audio storage chip of the present invention does not have a moving medium, such as tape, which by its nature, can be difficult to synchronize with a visual display. Another difficulty with a tape medium is the difficulty of maintaining the synchronicity of the tape over a life cycle that will likely include hundreds, if not thousands, of plays. Another advantage provided by the direct analog storage chip is that the storage mechanism employed by the device is much more efficient, and requires less memory than pure digital storage methods, such as those employed in floppy disks, hard disks, and digital compact disks.

It is also a feature of the present invention that it includes a multi-segment audio message, and a multi-element visual display. This feature has the advantage of providing a display that helps to both capture and hold the viewer's attention. The audio message helps to capture the viewer's attention, and the visual display helps to hold the user's attention throughout the duration of the message. Further, the combination of audio and visual displays enables the device to convey a large amount of information to the user about the advertised product, in just a very short period of time.

Another feature of the present invention is that it includes a housing having a front panel and a back panel that each include a plurality of spaced peripheral apertures, through which a fastener can be passed for securing the back and front panels together, and sandwiching the frame means therebetween. This feature has the advantage of providing a rugged, inexpensive housing member which, when necessary, can be disassembled easily to facilitate the replacement or repair of both the transparency and audio storage ("talker") chip, or the repair of the internal components of the device, such as the mother board, sensor board and the light.

These and other features will become apparent to those skilled in the art upon review of the detailed description contained below, which is believed by the applicants to describe the best mode of practicing the invention, as perceived presently.

IV. BRIEF DESCRIPTION OF THE DRAWINGS

Figure 9A:
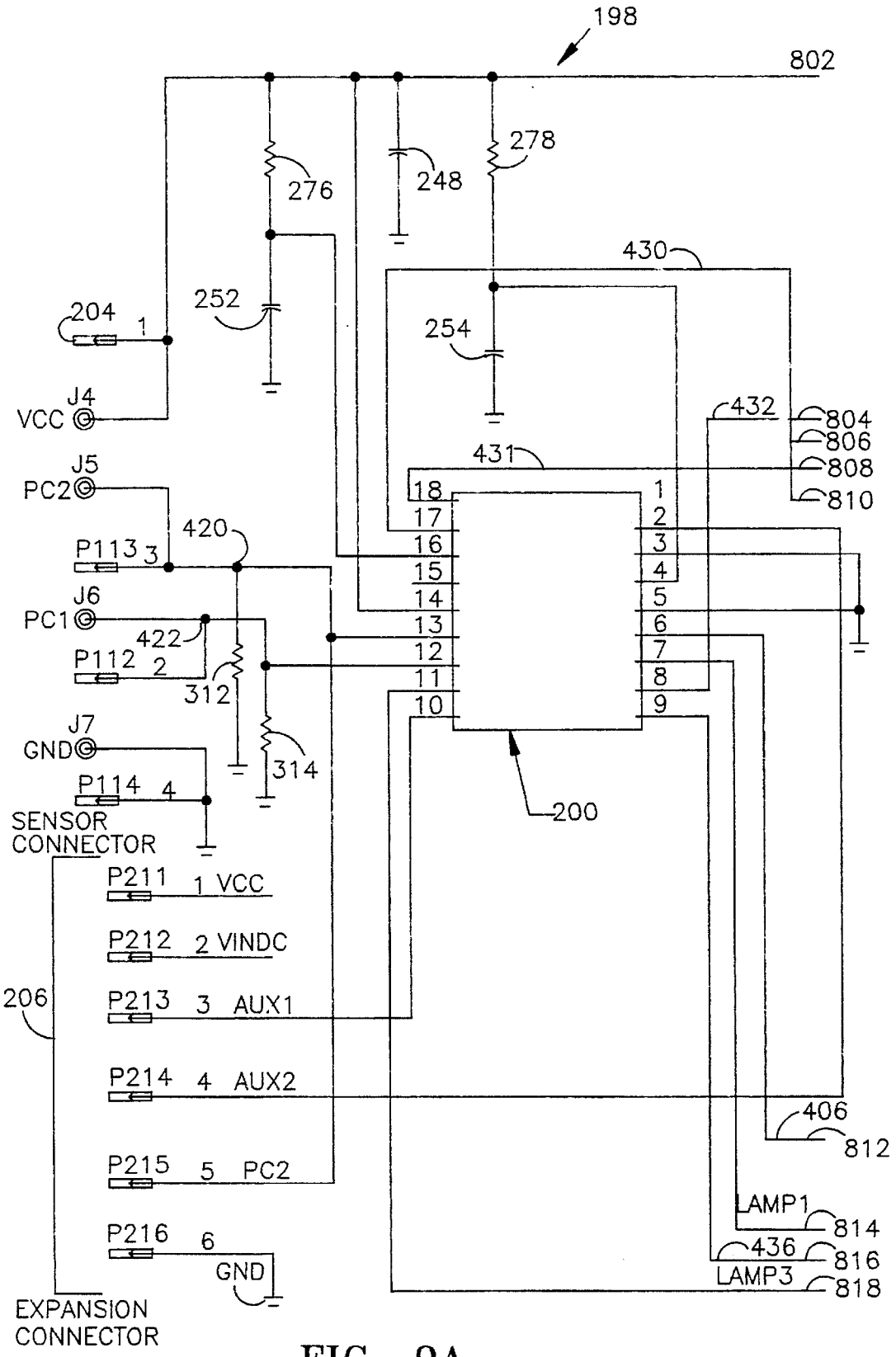
Figure 9C:
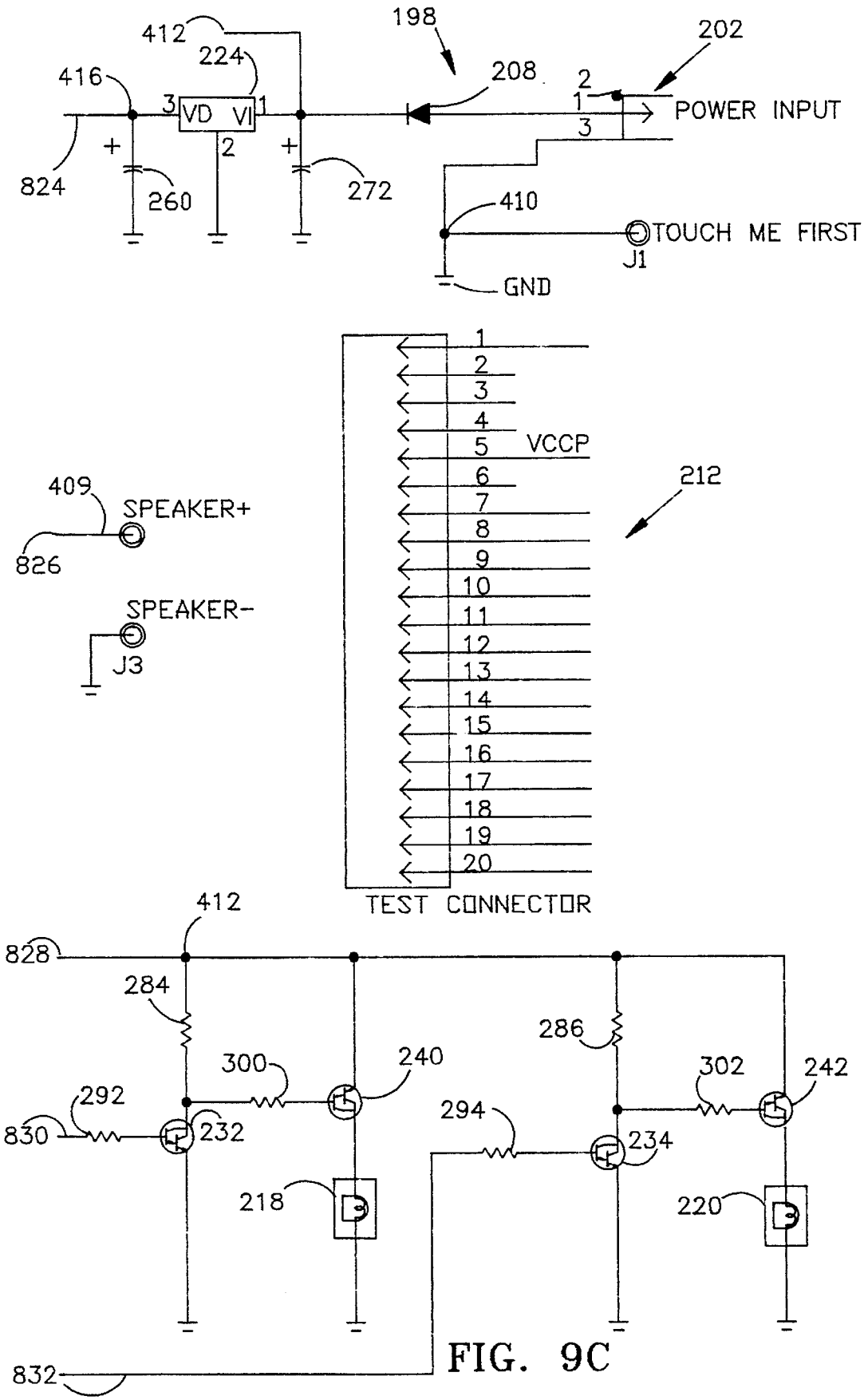
Figure 10:
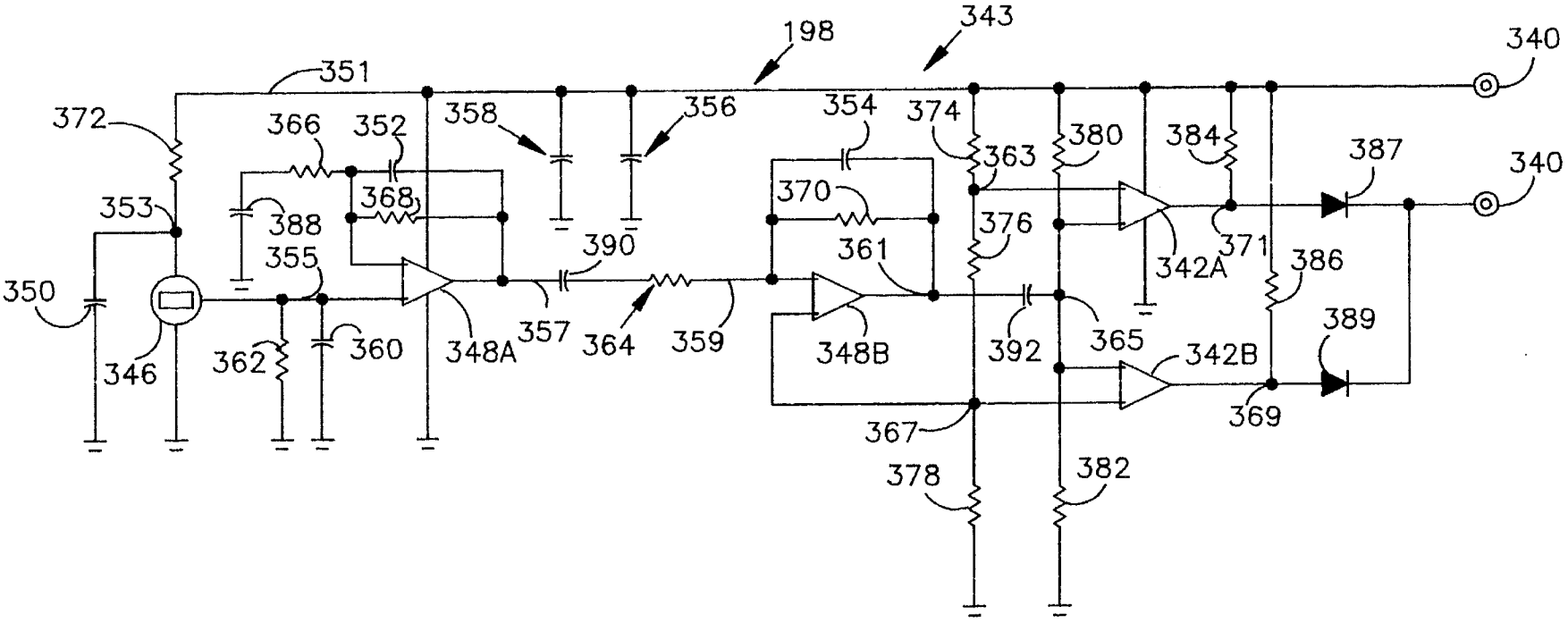
Figure 11:
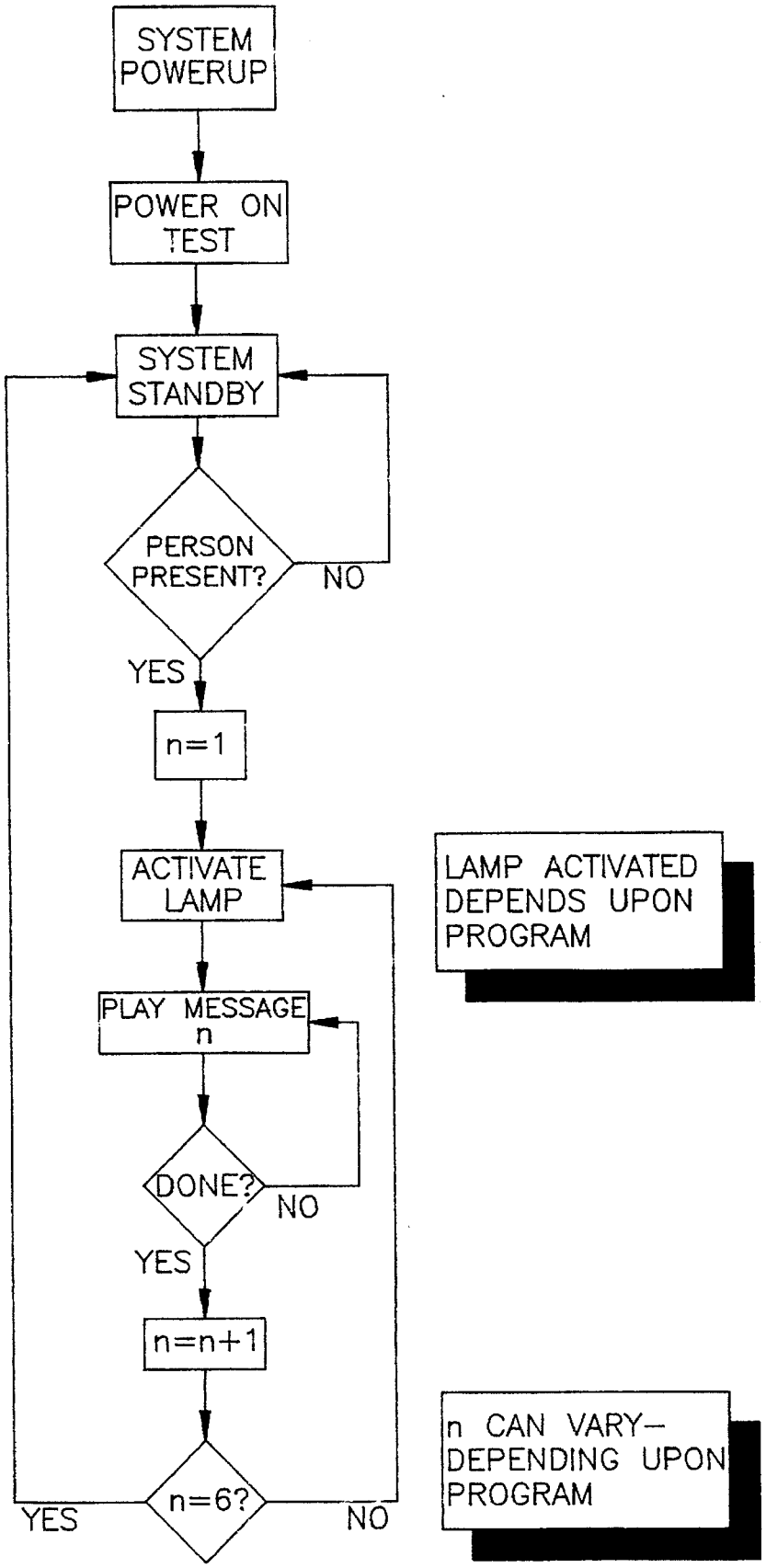

FIGS. 9A–9C, taken together, comprise a schematic view of the electronic control and audio circuitry of the device;

FIG. 10 is a schematic view of the sensor control circuitry of the device; and FIG. 11 is a flow chart that schematically illustrates the operation of the present invention.

V. DETAILED DESCRIPTION

A. The Mechanical Aspects of the Device

Figure 1:
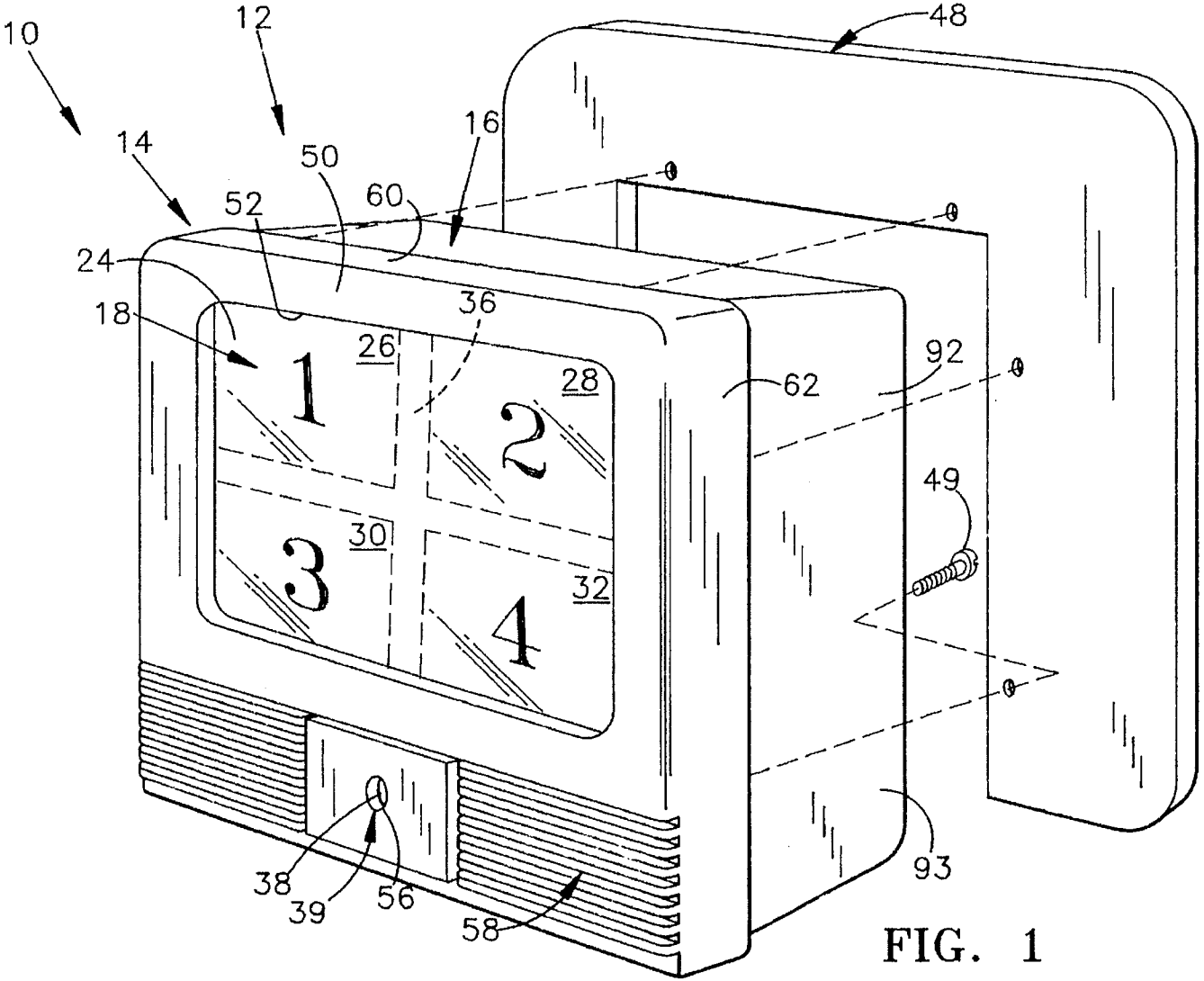
FIG. 1 is perspective view of the display device of the present invention.

It is best shown in FIGS. 1, 2, 4, 5 and 8, the electronic display device 10 includes a housing 12 having a front panel member 14, a rear panel member 16, and a frame means 18 sandwiched there between. The frame means 18 includes at least two, generally non-overlapping transparencies. In the present embodiment, the non-overlapping transparencies comprise a single sheet of film, containing four transparency portions. In the device 10 shown in the Figures, the transparency 24 includes a first transparency portion 26, a second transparency portion 28, a third transparency portion 30, and a fourth transparency portion 32. A discreet visual image is shown on each of the four transparency portions 26, 28, 30, 32. In FIG. 1, the discreet visual representation is shown as a "1" on the first transparency portion 26; a "2" on the second transparency portion 28; a "3" on the third transparency portion 30; and a "4" on the fourth transparency portion 32. In use, it is likely that the visual images would comprise pictures or drawings of the product being advertised or persons enjoying the products being advertised. A blackened-out divider portion 36 extends between the transparency portions 26, 28, 30, 32 to help maintain the discreetness of the four images 26, 28, 30, 32.

Figure 7:
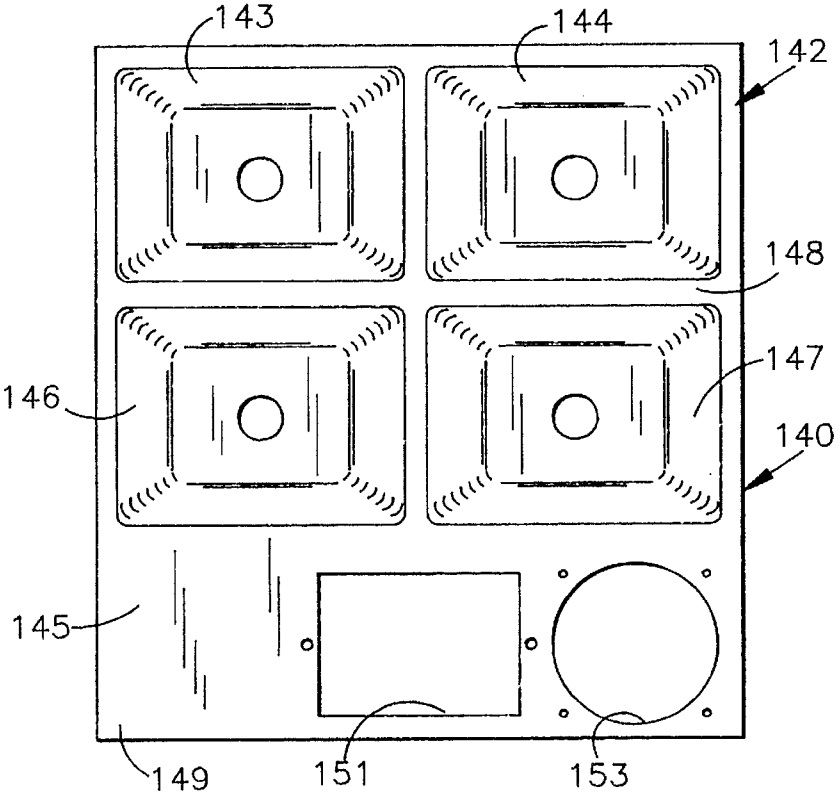
FIG. 7 is a front view of the reflector member of the device.
Figure 8:
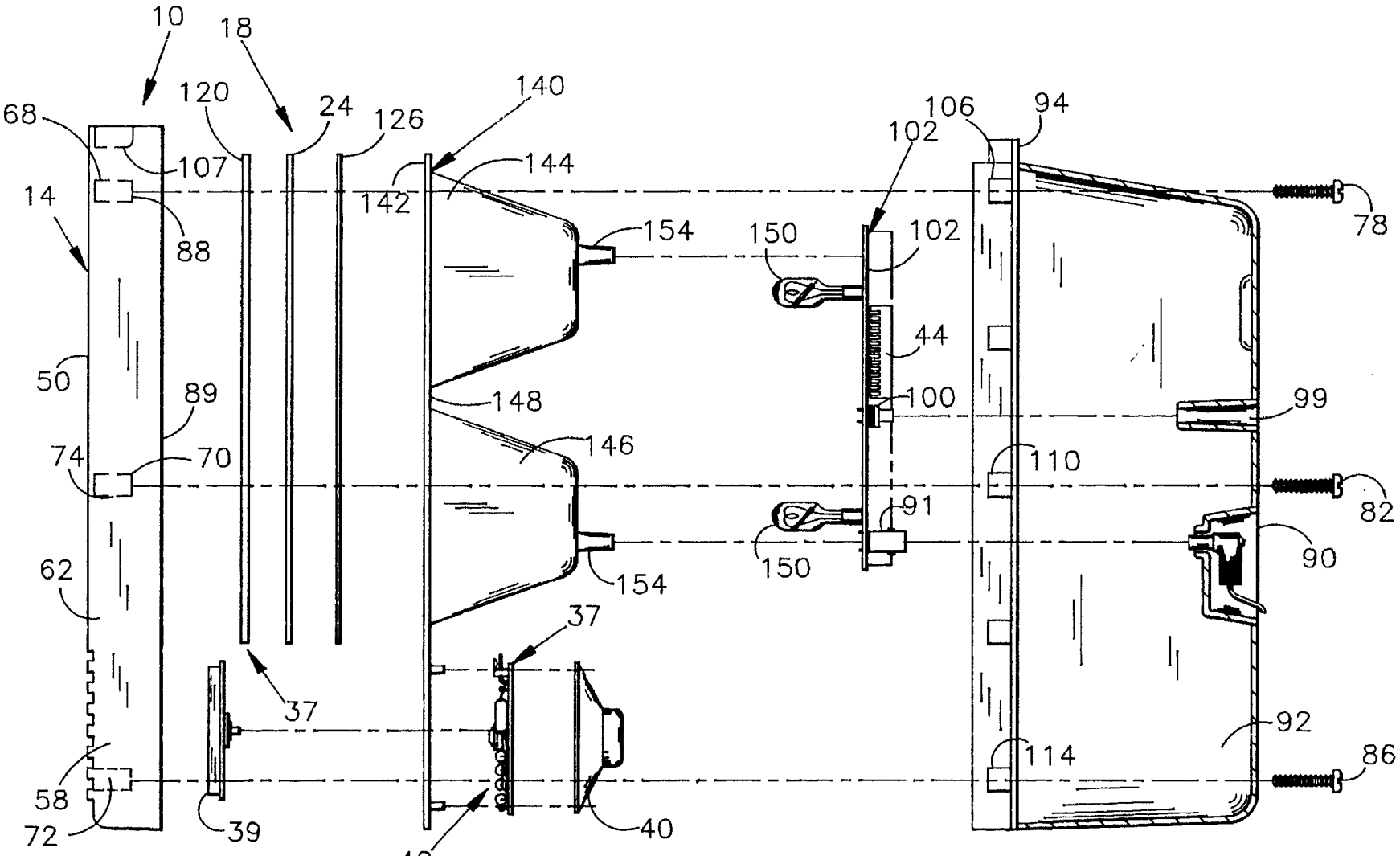
FIG. 8 is an exploded, side view of the device.

A sensor unit 37 (FIG. 8) having a pyro-electric sensor facing assembly 39 that includes pyro-electric motion sensor 38 (FIG. 1), and associated circuitry 42 is mounted to the front panel 14. As is best shown in FIGS. 1, 7 and 8, the photo-sensor facing assembly 39 is generally rectangular in shape, and extends through a rectangular cavity in the front surface 50 of the front panel 14, so that the front surface of the facing assembly 39 becomes a part of the front surface 50 of the device 10. Additionally, a speaker means 40 is mounted to the reflector 140. The device 10 also includes a means for delivering an audio message such as a direct analog audio chip 44, which is commonly referred to as a "talker chip." A controller means 46, which includes an integrated circuit, and associated circuitry is provided for controlling the operation of the direct analog audio chip 44, the speaker means 40, and the sensor means 38. In a preferred embodiment of the present invention, the audio storage chip 44 and associated circuitry 46 can be mounted generally co-planarly, and positioned between the reflector member 140 and the back panel 14 in the interior of the device 10, on a circuitboard 102 which also serves as a mounting bracket for the reflector member 140.

A billboard 48 can be attached to the housing 12 by mounting screws 49 for providing further information about the product to be advertised.

The front panel 14 of the device includes an exterior front surface 50 that defines a generally rectangular viewing aperture 52. The viewing aperture 52 is provided for receiving the frame means 18 adjacent thereto, for placing the four transparency portions 26, 28, 30, 32 within the viewing aperture 52, so that they can be seen by the user.

The lower portion of the front surface includes a central aperture 56 in which the pyro-electric sensor cell 38 of the sensor 37 are nested. As will be described in more detail below, the pyro-electric sensor 38 of the sensor circuit 37 detects infrared radiation radiated by a person in the vicinity of the device 10.

The lower portion of the front surface 50 of the device also includes an acoustically transparent grill portion 58. The speaker 40 is placed directly behind the grill portion 58, so that sound emanating from the speaker 40 will pass through the grill portion 58, so that it can be listened to by a viewer.

The front panel 14 also includes a top portion 60 disposed generally perpendicular to the front surface 50, and a pair of side portions 62 which are themselves disposed generally perpendicular to the front panel 50 and to the top portion 60.

Figure 6:
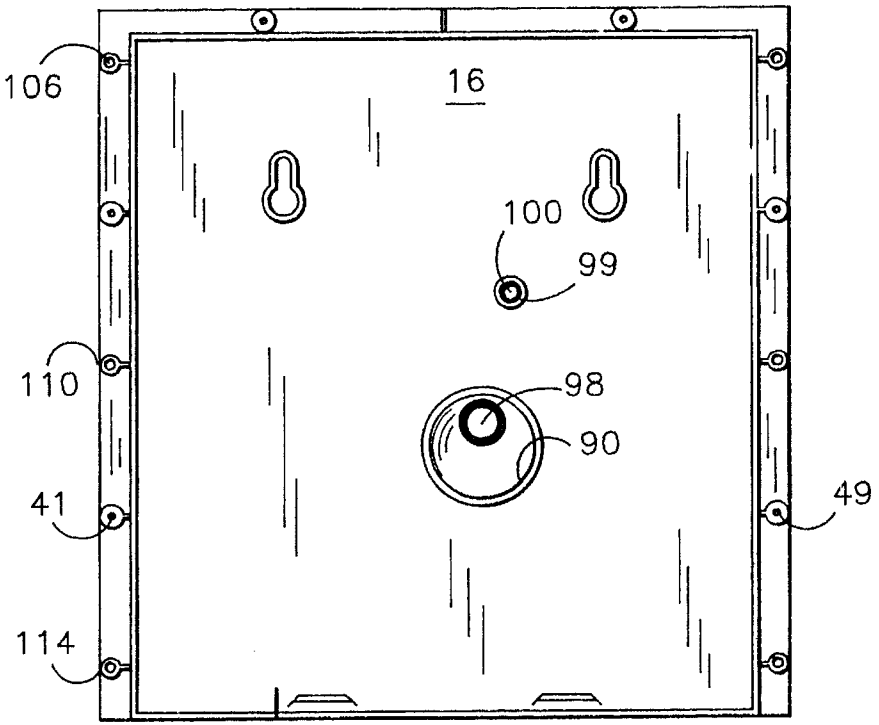
FIG. 6 is a rear view of the device.

As best shown in phantom in FIG. 8, the side portion 62 of the front panel 14 includes an array of apertures spaced about the periphery of the front panel member 14. Additionally apertures (not shown) are disposed in the top portion 60 of the front panel 14. In FIG. 8, only three apertures 68, 70, 72 are shown. In the actual device, additional apertures exist that are disposed along each of the side portions 62, and the top portion 60 of the front panel member 14. The position of the apertures can best be deduced by reference to FIG. 6. As best shown in FIG. 8, the apertures, e.g. 68–72 are not true apertures, as they do not have an opening at each end. Rather, they are rearwardly opening cavities having a closed end adjacent to the front surface 50 of the front panel 14. The apertures, e.g. 68–72, are threaded to receive threaded fastening means which fasten together the panels 14, 16 of the device. The threaded fastening means are shown to take the form of screws 78, 82, 86, which are positioned to be received by the apertures 68, 70, 72, of the front panel 14. It will be noted that the rearwardly opening ends 88 of each of the apertures is not disposed at the back edge 89 of the side portion 62 of the front panel member 14, but rather are recessed somewhat. This recessed placement of the apertures, e.g., 68–72 permits the back panel 16 to nest within the interior of the front panel 14, when the back panel 16 and the front panel 14 are joined.

Mounting means (not shown) such as push or fasteners are provided for mounting the speaker 40 to the rear surface of the reflector panel 140, to place the horn of the speaker 40 adjacent to the grill 58 in the front panel. Additionally, a mounting means (not shown) is provided for mounting the pyro-electric sensor cells 38 and their associated circuitry 42 to the front of the reflector panel 140, in a position adjacent to aperture 56.

The back panel 16 includes a rear surface 90 which is generally (but not exactly) parallel with the front surface 50 of the front panel 14, and a pair of side surfaces 92 which are disposed generally parallel to the side surfaces 62 of the front panel 14. The readers attention is directed now to FIG. 1 which provides a view of the respective shapes, and relations between the side surfaces 62 of the front panel, and the side surfaces 92 of the rear panel.

The rear surface 90 of the back panel 16 also includes a recessed plug cavity 96 which is designed for receiving a plug connector 98, for coupling the device to a low voltage source. The plug connector 98 is part of a low voltage (12 VDC) transformer/rectifier assembly that plugs into an AC outlet through a line cord. The plug connector 98 is coupled to a plug receiver 91 mounted to a mounting bracket which preferably comprises a circuit board 102. The rear surface 90 of the back panel 16 further includes a recessed volume control knob cavity 99 for receiving a volume control knob 100 for controlling the output volume of speaker 40.

A peripheral mating lip 94 extends generally around the front portion of the back panel 16. The mating lip 94 is sized and shaped for nesting within the interior of the front panel 14. A plurality of peripheral, spaced bosses are mounted on to the mating lip 94. In FIG. 8, three of the mounting bosses are shown, including bosses 106, 110, 114. Bosses, e.g., 106–114 are sized and positioned for aligning with the apertures, e.g., 68, 70, 72, of the front panel 14, so that when the front panel 14 and the rear panel 16 are joined, the fastening screws, e.g., 78, 82, 86 can pass through the respective bosses, e.g., 106, 110, 114 and engage the respective apertures, e.g., 68, 70, 72. When so joined, it will be appreciated that the frame means 18 and the reflector panel 140 become sandwiched between the front panel 14 and rear panel 16. When so sandwiched, the upper surfaces of each of the shield 120, transparency panel 24 and diffusion screen are engaged with a top positioning surface 107 formed on the interior surface of the front panel 14. Similarly, side positioning surfaces 108, 109 and formed on the interior surface of the front panel 14 for engaging the side surfaces of the shield 120, transparency panel 24 and diffusion screen 126 to hold them in position when they are sandwiched between the front panel member 14 and the rear panel member 16. Support members 111 (FIG. 2) are also provided for supporting the lower corners of the frame means 18 members 24, 120, 126.

Figure 2:
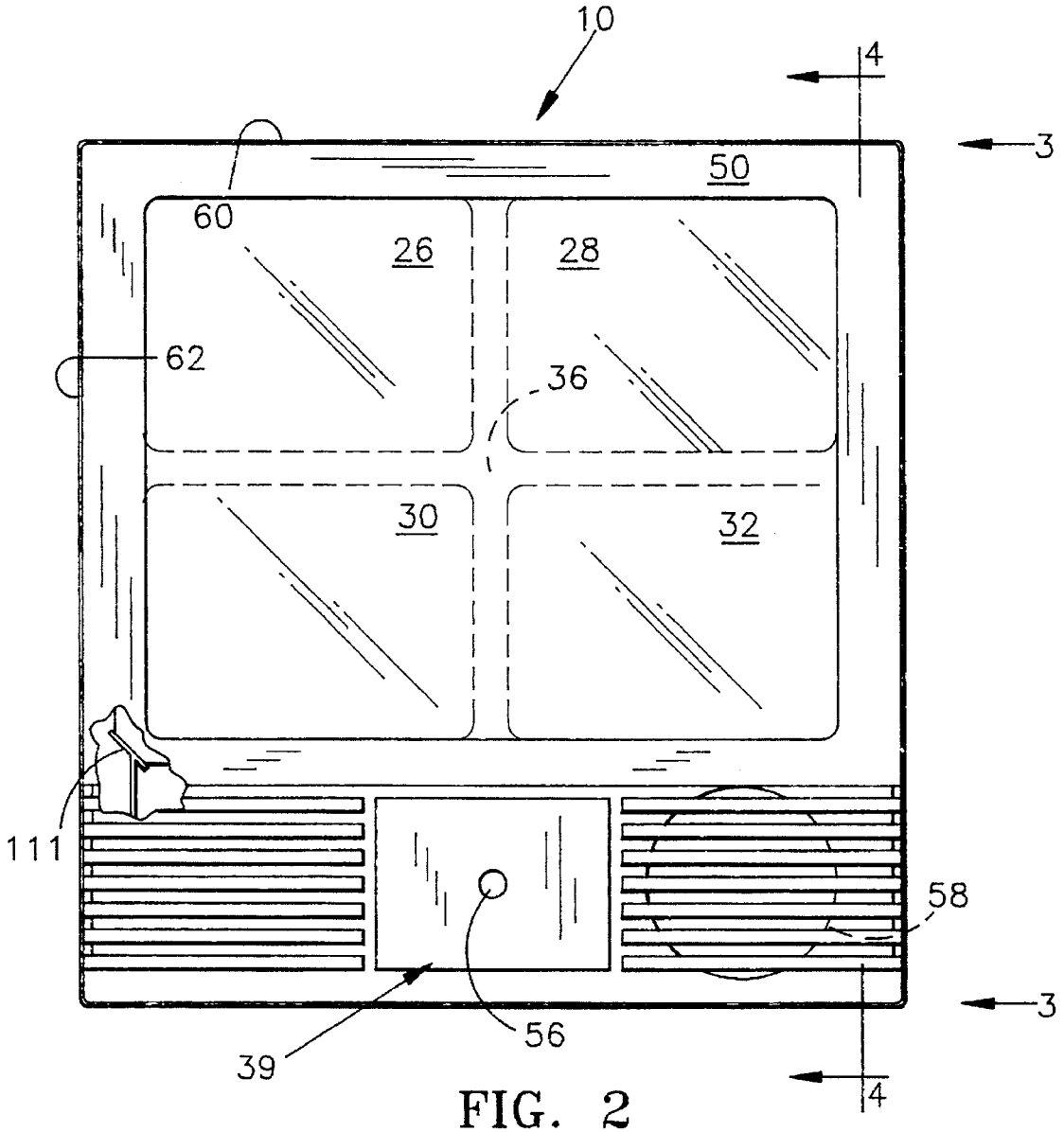
FIG. 2 is a front view of the device.
Figure 3:
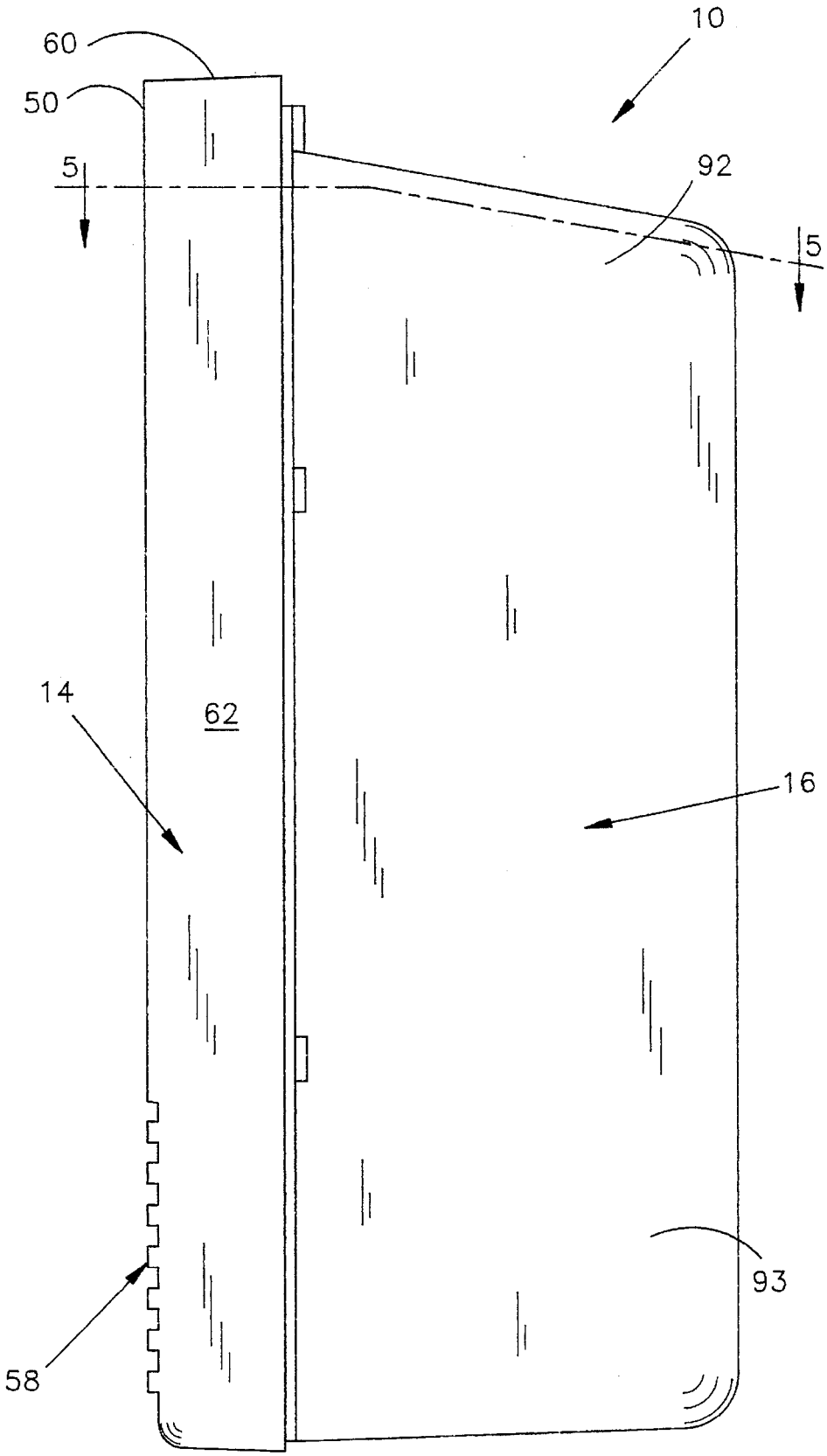
FIG. 3 is a side view of the device.
Figure 4:
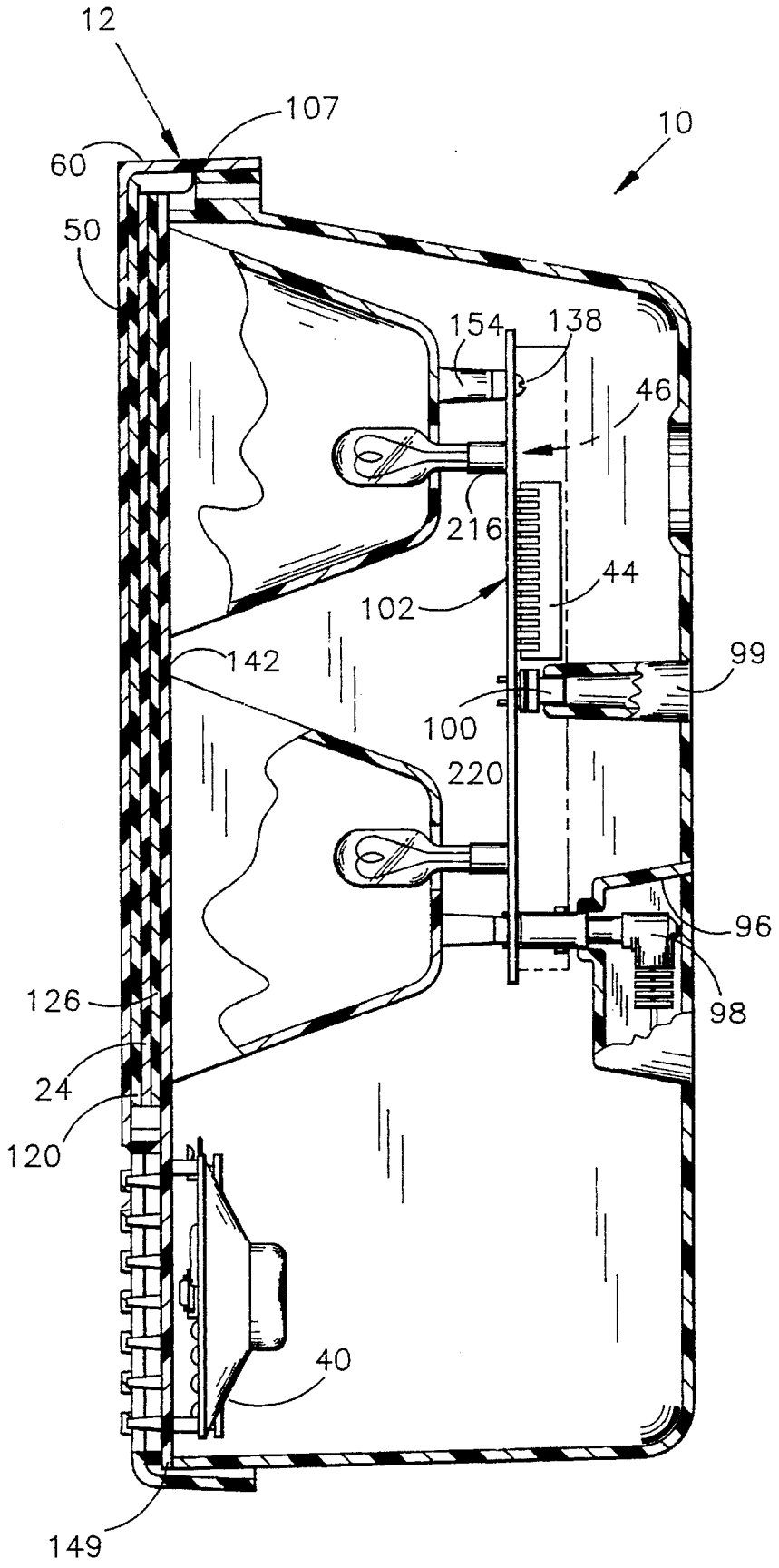
FIG. 4 is a sectional view taken along lines 4—4 of FIG. 2.
Figure 5:
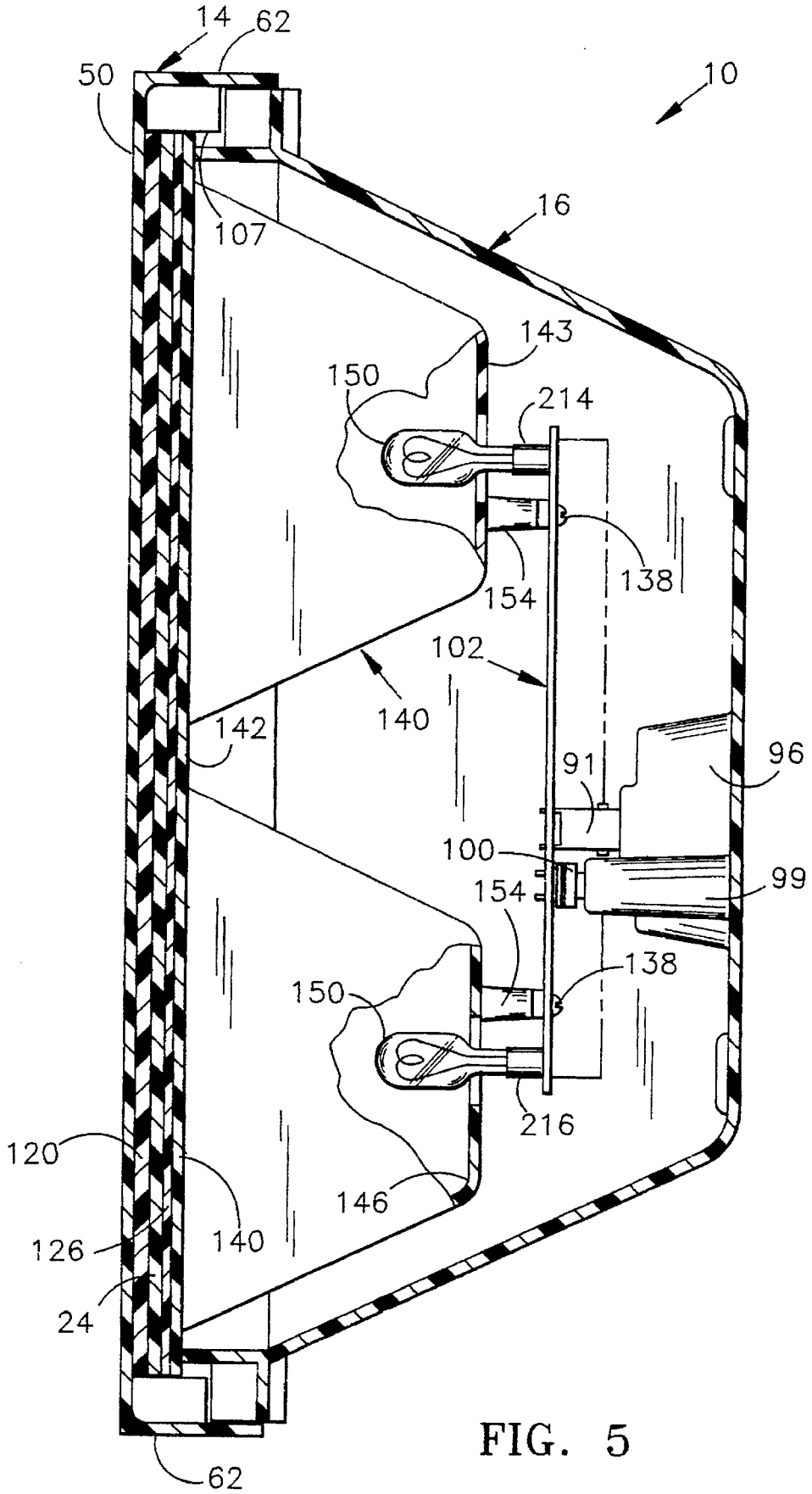
FIG. 5 is a sectional view taken along lines 5—5 of FIG. 3.

The frame means 18 is best shown in FIGS. 4, 5 and 8 as comprising a 3-layer sandwich including a clear glass or plastic outer shield 120, a middle transparency member 24, and an inner diffusion screen 126. The shield 120 can be made from a non-glare glass which produces especially good results when used in the device 10. Preferably, the shield 120 is made from an acrylic material having a gray tint which helps to hide the transparency 24 when the machine is off, but allows the transparency 24 to be seen when illuminated by lights 150. Transparency 24 generally comprises a single sheet of film containing at least two, and preferably four discreet visual images 26, 28, 30, 32 (FIG. 2). The diffusion screen 126 preferably comprises a sheet of translucent material such as white acrylic plastic.

A generally planar circuit board/mounting bracket 102 is best shown in FIGS. 4, 5 and 8 as being mounted by four mounting screws 138 to the reflector panel member 140. In addition to serving as a circuit board on which electrical components such as the controller 200 and talker chip (and associated circuitry) are mounted, the circuit board/mounting bracket serves as a mounting bracket for parts such as lightbulb sockets (e.g., 214, 216, 218 220) (FIGS. 9A–9C) and light bulbs 150. The reflector member 140 is mounted to the mounting bracket 102, and is positioned between the mounting bracket 102 and the diffusion screen 126 of the frame means 18. The reflector member 140 includes a formed spacer member 154 projecting rearwardly from each cavity for maintaining the reflector member 140 in a proper spaced relation from the mounting bracket 102.

As best shown in FIGS. 4, 5, 7 and 8, the reflector member 140 also includes a peripheral lip 142 which is disposed in a plane generally parallel to the plane of the diffusion member 126 of the frame means 18. The peripheral lip 142 includes an enlarged lower portion 145 which extends almost to the bottom of the interior of the device. The lower end 149 of the lower portion is captured by the front panel 14 and rear panel 16 for helping to secure the reflector member within the device 10.

The reflector member 140 further includes a plurality of discreet cavities, such as cavities 143, 144, 146, 147. As will be appreciated, the number of cavities should equal the number of transparency portions. Thus, in the device shown in the figures, the reflector member 140 includes four cavities 143, 144, 146, 147, which correspond to the four transparency portions 26, 28, 30, 32 of the device. Referring now to FIG. 7, cavity 143 corresponds to transparency portion 26; cavity 144 corresponds to transparency portion 28; cavity portion 146 corresponds to transparency portion 32; and cavity portion 147 corresponds to transparency portion 30. A divider portion 148 is disposed between the cavities. The purpose of the divider portion 148 is to maintain the light within each cavity separate from light within any of the other cavities, and to block the passage of light from one cavity to an adjacent cavity, so that when a particular bulb 150 is lit within a particular cavity, e.g., 144, only a single visual image, e.g., 28 will be illuminated. To accomplish this, the divider portion 148 is placed flush against the rear surface of the diffusion screen 126. A discreet light source, such as bulbs 150 are provided in each of the cavities, 143, 144, 146, 147. Sockets 214, 216, 218, 220 (see FIGS. 4, 5, 6 and 8) are provided for anchoring the bulbs 150 to the cavities.

The lower portion 145 of the reflector member 140 also includes a generally, centrally located rectangular cutout portion 151 positioned adjacent the sensor facing assembly 39, and through which the sensor facing assembly 39 can pass. The lower portion 145 of the reflector member 140 also includes a generally circular cutout portion 153 positioned adjacent to the horn of the speaker 40.

When the device is fully assembled, the mounting screws, e.g. 78, 82, 86, pass through the aligned apertures of the back panel 16 and front panel 14 to hold together and secure the various parts together. When so assembled, the frame means 18, and reflector member 140 are sandwiched between the front panel 14 and rear panel 16. When so assembled, the various components of the device are securely held within the device, to keep them from moving within the interior of the device 10.

B. The Electronics of the Device

The device 10 includes two major circuits for electronically controlling the operation of the device. One of the two major circuits is the circuitry that operates the sensor 37. The pyro-electric sensor cells 38 and their circuitry 42 are shown in FIG. 10. The other major circuitry component is the primary electronic control circuitry 198 shown in FIG. 9, which controls generally the operation of the device. First discussed will be the electronic control circuitry.

1. The Electronic Control Circuitry

As best shown in FIGS. 9A, 9B and 9C, the electronic control circuitry 198 includes the plurality of components. FIGS. 9A–9C comprise three sections of the same circuit, which would not fit, in its entirety, on a sample page. The "800" series of numbers on the figures (e.g. 802, 804, etc.) are used to designate connecting points on the three drawings so that, for example, point 802 on FIG. 9A meets with point 802 on FIG. 9B. The individual components that can be used in the electronic control circuitry 198 are set forth below in Chart 1, although it will be appreciated that adequate substitutes exist for some, if not most of the particular parts set forth below, such as equivalent parts manufactured by other manufacturers.

CHART 1
CONTROL CIRCUIT

| ITM | DESCRIPTION | MANUFACTURER | MFG PART NUMBER |
|---|---|---|---|
| 200 | IC, CMOS PIC 1K OTP 16C56-RC (Microprocessor/Controller) | MICROCHP | PIC16C56-RC/P |
| (not shown) | SOCKET, IC-18 PIN-SLEEVES | MOUSER | 151-318SGG (for use with 200) |
| 202 | POWER JAX, PCB MT 2.54MM STR. | SWITCHCRAFT | PC712A |
| 204 | HEADER, LOCK, STR-.1C 4 TERMS | MOLEX | 22-23-2041 |
| 206 | HEADER, LOCK, STR-.1C 6 TERMS | MOLEX | 22-23-2061 |
| 208 | DIODE, RECTIFIER IN4004 (400 V) | EXL | 333-IN4004 |
| 210 | FUSE 3AG SLO-BLO 2.0A (.25 DIA) | BUSSMAN | MDL-2 |
| (not shown) | FUSE CLIP .25 DIA FUSE PCB MT. | KEYSTONE | 3529 (for use with 210) |
| 212 | HEADER, STRIP, 2 ROW 10 POS | MFG ITEM | Make from next item |
| (not shown) | HEADER, STR.D-ROW 25 POS, SQ. PIN | AMP | 2-87227-5 (used to make header 212 |
| 214, 216, 218, 220 | SOCKET, T-5 LAMP-PC BOARD MOUNT | CHRISTIANA IND | CIC9500-.146 |
| 222 | IC,RECORD/PLAYBACK 60 SEC. DIP (audio storage chip) | ISD | ISD2560P |
| 152 | SOCKET, MOD IC SYS 28 PIN-TIN | MOLEX | 15-29-9282 (FIG. 2) |
| (not shown) | CARRIER, MOD IC SYS 28 PIN-TIN | MOLEX | 50-39-5288 (crimped into socket 152) |
| 224 | IC, VOLT REG LP +5V 78L005AP | EXL | 78L005AP |
| 226 | IC, AUDIO AMP LM386 | NATIONAL | LM386N-1 |
| (not shown) | SOCKET, IC-8 PIN | MOUSER | 151-9108 (used with Int. Cir. 226) |
| 228, 230, 232, 234 | TRANSISTOR, NPN, DARL MPS-A13 | EXL | MPSA13 |
| 236, 238, 240, 242 | TRANSISTOR, PNP, DAPL TIP125 (60 V) | SGS | TIP125 |
| (not shown) | HEATSINK, LO PROFILE TO-220 (.75 L.) | AAVID | 507302B (used with transistors 236, 238, 240, 242) |
| 150 | LAMP, T-5 CLR 12.8V-12CP-912 (1 AMP) | CHRISTIANA IND | 912 (FIG. 2) |
| 244 | TRIMPOT .5W IT 10K HORIZ PCB (volume control) | MEC | 409H-10K |
| 246, 248, 250, 252, 254, 256 | CAP, CER, MONO.1MFD/50V | THOMPSON/CSF | 581-UDW104M1 |
| 257 | CAP, ALUM RADIAL 4.7MFD/16V (.2 DIA) | XICON | XRL26V4.7 |
| 258, 260, 262, 264 | CAP, ALUM RADIAL 220MFD/16V (.32 DIA) | XICON | SRL16V220 |
| 266,268 | CAP, ALUM AXIAL 1MFD/16V (.2 DIA) | XICON | 140-XAL16V1.0 |
| 270 | CAP, ALUM RADIAL 47MFD/50V | XICON | XRL5OV47 |
| 272 | CAP, ALUM RADIAL 22DMFD/50V (.39 D.) | XICON | 140-XRL50V220 |
| 274 | CAP, ALUM RADIAL 10MFD/16V (.2 DIA) | XICON | SRL16V10 |
| 276, 278, 280, 282, 284, 286, 288, 290, 292, 294 | RES 1/4W 5% 10K | MOUSER | ME295-10K |
| 296, 298, 300, 302 | RES 1/4W 1% 470 | MOUSBR | 29F50-470 |
| 304 | RES 1/4W 1% 10 | MOUSER | 29MF250-10 |
| 306 | RES 1/4W 1% 300 | MOSUER | 29MF250-300 |
| 308 | RES 1/4W 1% 470K | MOUSER | 29MF250-470K |
| 310 | RES 1/4W 5% 1K | MOUSER | ME295-1K |
| 312, 314 | RES 1/4W 1% 56K | MOUSER | 29MF250-56K |
| (not shown) | PCB MACH, SINGLE BOARD EDS | MILPLEX | MC013851 |

The electronic control circuitry 198 (FIGS. 9A, 9B, 9C) consists of three functional modules: (1) the lamp drivers; (2) the audio amplifier; and (3) the electronic power supply.

The lamp driver portion of the circuit comprises four individual circuits, one for turning on and off each of the four lamps 150 of the particular display 10 (FIG. 1) shown in the drawings. Of course, in a display having more or less lamps than four, a number of circuits corresponding to the number of lamps would be used. The lamp driver circuits are provided for selectively providing electricity to the four lamp sockets 214, 216, 218, 220 (FIGS. 9B and 9C) which are provided for holding the four lamps 150 (FIG. 5) of the present invention.

Described below is the operation of one of the four lamp circuits. It will be appreciated, that all four lamp circuits operate generally identically.

PNP transistor 236 (FIG. 9B), and NPN transistor 228 are connected to a 12 volt DC power supply connector 202 (FIG. 9C). A connector line extends between resistor 288 (FIG. 9B), to an output pin of microprocessor 200 (FIG. 9A). The circuit output at socket 214 (FIG. 9B) is connected to a 12 volt DC lamp, such as bulb 150 (FIG. 5). In normal operation, the microprocessor 200 (FIG. 9A) keeps point 406 of the circuit at a low voltage. Since point 406 is at a low voltage, transistor 228 (FIG. 9B) is off, and point 402 (between transistor 228 and resistor 280) is at a relatively higher voltage, approximately 11 volts. Since point 402 is at a relatively higher voltage, transistor 236 is held off. This condition keeps the output voltage at socket 214 low, thus keeping the lamp 150 (FIG. 5) off. When the microprocessor 200 (FIG. 9A) desires to actuate the bulb attached to socket 214 (FIG. 9B), the voltage at point 406 goes to approximately 5 volts, and turns on transistor 228 (FIG. 9B). When transistor 228 turns on, the voltage at point 402 goes low, to approximately 0.5 volts. Bias current then flows through resistor 296, and transistor 236 turns on. Once transistor 236 turns on, collector current flows, and the voltage at the socket 214 goes to approximately 11 volts. The voltage at the socket 214 then lights the lamp load. The circuit 198 will continue in this manner until the microprocessor 200 desires to turn off the lamp 150 (FIG. 5). At such point, the voltage at point 406 goes to low again, thus turning off transistors 228, 236 (FIG. 9B).

All four lamp drivers operate in a manner similar to that described above.

The audio amplifier circuit takes the audio output from the direct analog storage technology chip ("DAST") 222, and amplifies the signal that is delivered to the speaker 40 (FIG. 9C). The audio signal from the audio storage chip 222 (FIG. 9B) is applied to point 404 through capacitor 266. This signal is also applied to the volume control pot, variable resistor 244. Resistor 244 is physically located on the rear side of the board holding the electronic circuitry 102 (FIG. 8), so that it can be easily adjusted from the rear of the display unit 10 (FIG. 1). The setting of the volume control pot resistor 244 (FIG. 9B) determines the level of audio input signal at point 406, between volume control pot resistor 244, and audio amplifier 226.

The signal level at point 406 is applied to audio amplifier 226. Audio amplifier 226 amplifies the signal and the output appears at point 408. The output is then coupled through capacitor 264 to point 409 (FIG. 9C) wherein it is outputed to the speaker 40 of the electronic display unit 10 (FIG. 1). By adjusting the setting of the variable resistor pot 244 (FIG. 9B), the level of the signal applied to the amplifier 226 is adjusted, thus controlling the volume level of the speaker 40 (FIG. 9C).

The electronics' power supply is a source of five volt DC power for the electronic items in the direct analog storage chip 222 (FIG. 9B), controller chip 200 (FIG. 9A), and audio amplifier 226 (FIG. 9B). Basically, the circuit converts 12 volt DC power from the external power supply to 5 volts. The external 12 volt DC power supply supplies input power to the power jack 202 (FIG. 9C). Diode 208 serves to assure that the applied power is of the correct polarity. For the unit to operate, the power at power jack 202 must be positive with respect to the ground at point 410 of the circuit 198. Input voltage from the external power supply must be in a range of between about 12 and 13.5 volts DC. The voltage at point 412 of the circuit is thus protected against improper polarity. Although not shown in the schematic, point 412 of the circuit 198 shown in the upper left hand corner of the schematic is coupled to the lamps, to serve as a source of power to light the lamps 150 (FIG. 5) of the device.

Thus, power is provided to the 12 volt lamps 150 used in the display unit, through the various sockets 214, 216, 218, 220, (FIG. 9A–9C) which accompany each of the four lamps respectively. Point 412 (FIG. 9C) of the circuit also provides power to the voltage regulator 224. Voltage regulator 224 takes an input voltage on its first pin, and reduces it to 5 volts DC at its output pin 3 at point 416. Capacitor 260 serves as a means for smoothing out the DC ripple, and keeping the 5 volt DC power supply "clean." The output of five volts is also coupled to the sensor circuitry 42 (FIG. 8) at point 204 (FIG. 9A). The output is also coupled to the audio storage chip 222 (FIG. 9B), controller chip 200 (FIG. 9A) and audio amplifier 226 (FIG. 9B).

One of the primary components of the present invention is the audio storage "talker" chip 222 and its associated circuitry. Talker chip 222 comprises a direct analog storage chip device. Such direct analog storage chip devices are manufactured by Information Storage Devices of San Jose, Calif. The purpose of the audio storage chip is to record and store audio information, for replay later. Audio storage chip 222 differs substantially from either a traditional analog storage device such as a vinyl record, or audio tape; or an electronic storage device, such as a floppy disk, hard drive, or CD Rom which stores materially digitally.

One drawback with traditional analog storage devices is that they usually require some sort of mechanical or electromechanical moving part to retrieve the information contained therein. In a case of a vinyl record, the movable part comprises a movable turntable on which the movable record is played, and a stylus for tracking the grooves containing the analog information in the record. In a tape recorder, the moving medium comprises tape, and the various capstans, motors, spindles and the like that transport the tape past the heads that retrieve the analog information. However, even through analog storage technology does suffer the drawback of requiring moveable parts, it has an advantage in that it permits the storage of a large amount of information in a relatively small space.

Digital storage devices suffer the drawback of requiring usually very large amounts of storage capacity for storing the complex signals that typically comprise a voice message. These storage requirements are especially exacerbated in view of the large number of "bytes" of information required to reproduce a complex audio signal such as a voice or music signal. For example, a typical digital storage compact disc can hold an entire encyclopedia set, but only approximately 72 minutes worth of music. The analog audio storage chip used with the present invention combines the best features of both analog and digital reproduction. While it is beyond the scope of this application to explain the complete function and operation of a direct analog storage technology type audio storage chip, suffice it to say that the audio storage chip 222 contains a large number of capacitors, which, when storing recorded information, are kept at certain "analog like" levels of charge for an indefinite period of time. An audio sound is reproduced from the chip by reading these various capacitors. As such, the audio storage chip can store a large amount of information in a relatively small amount of storage capacity, without the need for moving parts which can wear out and break down, such as those found in tape recorders.

A further explanation of a direct analog storage chip of a type that can be used with the present invention (Part No. ISD-2560) is described in the ISD Booklet titled "Application Notes and Design Manual for ISD's Single-Chip Voice Record/Playback Devices." As explained in this book, the audio storage chip has both a playback and a record mode. Although the present invention display unit contemplates the use of an audio storage chip 222 only in its playback mode, (with the "record mode" to be used off-site), the display unit 10 (FIG. 1) can be configured to be used with a microphone, so that a message can be recorded directly into the device 10. It will be appreciated that his type of modification would require a modification to the design of the PC Board. It should also be noted that talker chips such as DAST chip 222 (FIG. 9B), are available in different models. The model listed above (ISD 2500) is a chip capable of containing sixty seconds of voice information. However, a "20 second" chip (model IDS 1000) is also available, which is both less expensive, and is capable of holding less information than the "60 second" chip. Described below is the operation of the sixty second chip.

It is important to note that the audio storage chip of the preferred embodiment of the present invention is programmed to play an audio message that is comprised of a plurality (e.g., six) of sequentially played audio segments. As will be described in more detail below, each of the segments is played during the illumination of one or more usually different visual images 26, 28, 30, 32 (FIG. 1).

The operation of the audio storage chip device 222 (FIG. 9B) will be described below. Capacitor 268 sets the low end frequency response for the audio portion of the circuit. This capacitor 268 is connected between the ANA OUT pin and the ANA IN pin on the audio storage chip 222. The ANA OUT pin is a direct output from the internal mike preamplifier of the audio storage chip 222. The ANA IN pin goes directly into an internal amplifier of the audio storage chip 222. The coupling between the two amplifier stages is determined by the value of capacitor 268. This in turn, determines the low frequency response of the audio circuit.

Although not used in the present invention, a resistor and capacitor can be provided to determine the "attack" and "release" times for the automatic gain control circuits in the microphone preamplifier.

The controller chip 200 (FIG. 9A) controls the operation of the audio delivery system. The controller chip 200 has been programmed for a certain response to external signal changes. Controller chip 200 receives input from the sensor circuit 37 (FIG. 8) at points 420 and 422, (FIG. 9A) and activates the audio storage chip 222 (FIG. 9B) to play back the appropriate message. In addition to playing the correct audio message segment, the controller chip 200 (FIG. 9A) also activates the appropriate lamp 150 (FIG. 5) in sockets 214, 216, 218, 220 (FIGS. 9A–9C) to be turned on at the appropriate time.

Whenever the detector circuit senses a person within the vicinity of the front of the device, a high voltage condition (+5 volts) is presented at point 422 (FIG. 9A). If a push button switch is used to activate the device 10 (as opposed to a sensor), point 420 will go high. This high pulse is then detected by the controller chip 200. Immediately after receiving a "start pulse" from either of point 420, point 422 (and hence from the sensor 37 (FIG. 8)), the controller chip 200 (FIG. 9A) sets point 430 low. This low-going pulse takes the audio storage chip 222 (FIG. 9B) out of the "standby" mode. When the controller chip 200 (FIG. 9A) goes out of the standby mode, it will ignore any further instructions from the sensor 37 (FIG. 8) to "start operation." This "selective ignorance" of messages being sent from the sensor will continue until the audio storage chip 222 (FIG. 9B) has played its entire message, or the device 10 (FIG. 1) is shut off, such as by being unplugged.

The voltage at point 406 (FIG. 9A) then goes high causing the first lamp, (which is attached to socket 214) (FIG. 9B) to turn on. After a suitable delay, the voltage at point 432 (FIG. 9A), which is normally held at +5 volts, goes low. It is this low voltage pulse at point 432 on pin 23 of the audio storage chip 222 (FIG. 9B) that starts the playback of the first audio segment of the device.

During the time that the audio storage chip 222 is playing the first segment of the audio message, the controller chip 200 (FIG. 9A) monitors the voltage at point 431 (which is the "EOM" line). Normally the voltage at point 431 is at +5 volts. However, this voltage goes to zero for a short time at the end of each audio segment. This voltage change is detected by the controller chip 200 as a signal from the audio storage chip 222 (FIG. 9B) that the first audio segment is over. When the controller chip 200 (FIG. 9A) detects the signal that the first audio segment is over, it sets the voltage at point 406 low, to thus turn off the lamp attached to socket 214 (FIG. 9B). Thus, the first lamp, showing the first visual display (e.g., 26 FIG. 1) is shut off.

After another delay, the voltage at point 432 (FIG. 9A) again goes low, and thereby activates the second audio segment to be played by the audio storage chip 222 (FIG. 9B). Playback of the second segment of the audio message then begins. However, before the second audio segment is played, the controller chip 200 (FIG. 9A) causes the voltage at a second light, such as at point 436 to go high, to thereby turn on a second lamp, such as the "third lamp," which is connected to third socket 218 (FIG. 9C). This thus causes the third visual display 30 (FIG. 1) to become lit. As will be appreciated by those skilled in the art, the controller can be programmed to light the various lights in any sequence, depending upon the desires of the user.

The basic processes described above continue, with the audio storage chip 222 (FIG. 9B) sending a signal to the controller chip 200 (FIG. 9A) that the second audio segment is over, thereby causing the light in the third socket 218 (FIG. 9C) to shut off. Another light is then lit, to display a third visual message, and the third audio segment begins. The controller chip 200 (FIG. 9A) can be programmed to light multiple lights simultaneously, or to have one of the four lights shown in the preferred embodiment to be lit during more than one segment. For example, the controller chip 200 of an embodiment constructed by the applicant includes four visual displays 26, 28, 30, 32 (FIG. 1) and six audio segments. During the six audio segments, at least one of the displays, e.g., visual display 26, is lit during two of the audio segments. Further, the device can be programmed so that during one of the audio segments, two of the displays, e.g., first visual display 26, and fourth visual display 32, will be lit simultaneously during the playing of an audio segment. The exact mix of visual displays lit, and audio segments played, is a feature which can be programmed into the controller 200 (FIG. 9A) of device 10 (FIG. 1) to meet the particular desires of the user of the device 10.

2. The Sensor Circuitry

As best shown in FIG. 10, the sensor circuitry 343 includes a plurality of components. The individual components that can be used in the sensor circuitry 343 are set forth below in Chart 2, although it will be appreciated that substitutes exist for some, if not most of the particular parts set forth below, such as equivalent parts manufactured by other manufacturers.

CHART 2
SENSOR CIRCUIT

| ITM | DESCRIPTION | MANUFACTURER | MFG PART NUMBER |
|---|---|---|---|
| 340 | HEADER, RA LOCK-.1C 4 TERMS | MOLEX | 538-22-05-3041 |
| 342A, 342B | IC, COMPARATOR-DUAL LM393 | SGS-THOMPSON | LM393N |
| 346 | SENSOR, PYROELECTRIC-IR TO5 CAN | HAMAMATSU | P3514-02 |
| 348A, 348B | IC,OP-AMP DUAL LM358 | SGS-THOMPSON | LM358ANE |
| (not shown) | SOCKET, IC-8 PIN | MOUSER | 151-9108 USED WITH 342, 344 & 348 |
| 350 | CAP, ALUM AXIAL 10MFD/16V 0.2 DIA | XICON | 140-XAL16V10 |
| 352, 354 | CAP,CER MONO .01MFD/100V | THOMPSON/CSF | 581-UEW103M1 |
| 356 | CAP,ALUM AXIAL 22MFD/25V | XICON | 140-XAL25V22 |
| 358, 360 | CAP, CER, MONO .1MFD/50V | THOMPSON/CSF | 581-UDW104M1 |
| 362, 364 | RES 1/4W 1% 51.1K | MOUSER | 29MF250-5.1K |
| 368, 370 | RES 1/4W 1% 2.2M | MOUSER | 29MF250-2.2M |
| 366 | RES 1/4W 1% 5.1K | MOUSER | 29MF250-5.1K |
| 372, 374, 376, 378 380, 382, 384, 386 | RES 1/4W 5% 10K | MOUSER | ME295-10K |
| 388, 390, 392 | CAP,ALUM AXIAL 47MFD/16V | XICON | 140-XAL16V47 |
| 387, 389 | Diode, Rectitier (In 914) | EXL | (393 IN 914) |
| (not shown) | PCB MACH, M5-1R BOARD | MILPLEX | MB013849 |
| (not shown) | HOUSING, PYRO SENSOR | TBS DESIGN SERV | MA013853 |
| (not shown) | SCREW,RH #4-40 × 3/8 STL ZI PL | MOUSER | 572-01881 |
| (not shown) | WASHER, LOCK INT TOOTH #4 STL | MC MASTER CARR | 91113A005 |
| (not shown) | NUT, HEX #4-40 STEEL ZI PLTD. | H H SMITH | 1365 |

The sensor shown in FIG. 10 comprises an infrared sensing device, which senses a change in temperature caused by a body passing in front of the sensor. Although the present invention contemplates the use of an infrared sensor, it will be appreciated that other sensors will function. For example, a doppler sensor that operates in either the radio range, or in the ultrasonic range of the electromagnetic spectrum will also perform the intended function of sensing the presence of a person adjacent to the device 10.

Presented below is a description of an infrared sensor circuit that will function the present invention.

The infrared sensor circuitry comprises three primary functional components. The first functional component is the infrared sensor itself 346. The second component is the first stage (front end) gain circuitry, and the third functional component is the signal processing circuitry for processing the amplified sensor signal.

The sensor circuitry has been designed around a dual element pyro-electric infrared sensor 346. Specifically, the circuit has been designed to work with the Hamamatsu Model No. P3514-02 dual element sensor with a lens cap. Additional information about this particular model Hamamatsu sensor may be found in product sheets published by Hamamatsu.

Pyro-electric sensors detect infrared radiation (IR) from the human body, and convert the detected radiation to heat. This heat is converted to an electrical charge that lasts for a few milliseconds. It is this electrical charge (voltage pulse) that is capable of being detected by external electronic circuitry.

Pyro-electric can be observed in a variety of crystals and ceramics. These substances generate an electrical charge when their temperature changes. Commercial pyro-electrical materials have been developed to give a large electrical charge from a relatively small temperature change. The pyro-electric detector used in the circuit of the present invention has been fabricated from the crystal from lithium tantalate ($LiTaO_3$).

Again, it must be emphasized that the sensor operates on the principal of temperature change. When a person moves into the sensor area, infrared radiation that radiates off the body of the person is converted to heat, and thereby converted to a short term electrical charge that lasts for a few milliseconds. Any external circuitry used for the sensor must be capable of detecting and reacting to this short term electrical pulse.

Operation of the sensor circuitry can best be accomplished in connection with the circuit 343 shown in FIG. 10. In the description given below, various points of the circuit are discussed, to describe various voltage changes that occur during the operation of the circuit 343.

A voltage 340 is applied to the circuit 343. Point 351 in the circuit is typically at a voltage of +5 V, which represents the power supply voltage necessary for the operation of the sensor and the associated circuitry. The sensor circuit includes a resistor 372 and a capacitor 350 that decouple the power supply voltage for the infrared sensor 346. Resistor 372 and capacitor 350 are used to prevent power supply noise from disturbing the IR sensor element 346.

Point 355 in the circuit is normally kept at a voltage of approximately 0.6 volts DC. However, the voltage at point 355 will vary depending on background temperature. Typically, the background temperature the IR sensor "looking at", will cause the voltage at this point to vary from between about 0.5 volts to about 0.7 volts. Whenever a warm object, such as a human body, moves into the detection area of the sensor, the IR sensor element 346 produces an electrical pulse in the range of about 2 to 3 millivolts. This pulse is either added to or subtracted from the approximately 0.6 DC voltage at point 355. The sensor output pulse is amplified by amplifier 348A, and outputted to point 357 of the circuit 343.

Depending upon the background temperature that the IR sensor is "looking at", the voltage at point 357 will vary between about 0.4 volts and 0.8 volts. For example, in a typical environment the voltage will be approximately 0.65 volts. When the IR sensor 346 detects a temperature change caused by the movement of a warm body, such as a human body, into the range of the sensor, the 2 to 3 millivolt pulse generated by IR sensor 346 will be amplified to 0.33 volt. The amplifier gain circuit of amplifier 348A, capacitor 388, resistor 366, capacitor 352, and resistor 368 has been designed to furnish a gain of 111 when the motion frequency is 4 Hz. When a person approaches from the sensor left, the voltage point 357 is reduced by the pulse amplitude. However, when the person approaches from the sensor right, the voltage point 357 is increased by the pulse amplitude.

The plus or minus pulse from point 357 of the circuit is coupled through capacitor 390 and resistor 364 to point 359. Amplifier 348B has been designed to have a DC gain of approximately 43 (370 divided by 364). Therefore, the pulse at point 359 (which is approximately plus or minus 0.33 V) is amplified by 43, and is coupled to point 361. As such, the normal voltage at point 359 is some where between 1 and 2 volts.

The voltage at point 361 will vary between 0.7 and 3 volts. Because amplifier 348B is an inverting amplifier, the voltage pulse at point 361 will be the opposite polarity of the pulse at point 359. For example, a person approaching sensor right will cause the voltage at point 361 to be reduced, and a person approaching sensor left will cause the voltage at point 361 to be increased.

Point 363 of the circuit is typically set at a voltage of 3.4 volts. This is the "upper trip" point voltage for IC comparator 342A. In other words, the voltage on the positive input of comparator 342A (point 365) must exceed 3.4 volts before the output (point 371) will go high and signal a valid talk condition.

The lower trip point voltage at point 367 for comparator 342B is approximately 1.7 volts. The voltage on the negative input of the comparator 342B (point 365) must go below this 1.7 voltage before the output at point 369 will go high and signal a valid talk condition.

With no signals present, the voltage at point 365 is approximately 2.5 volts. When a person approaches the sensor from the right the voltage at point 365 will be reduced. When the point voltage at point 365 has been reduced below the 1.7 volt setpoint voltage at point 367, the output of comparator 342B (point 369) will go high momentarily. This is considered a valid talk signal. In a similar manner, when a person approaches from sensor left, the voltage at point 365 will be increased. When the voltage increases above the 3.4 volt setpoint at point 363, the output of comparator 342A (at point 371) will go high momentarily. This condition is also considered to ba valid "talk" signal.

The left approach output at point 371 is typically between 0.3 and 5 volts. When the device is in a condition where no person is in the sensor field, the voltage at point 371 is 0.3 volts. When the movement of the person is detected, the voltage at point 371 will momentarily jump to 5 volts.

The right approach output is at point 369, and also typically varies between 0.3 and 5 volts. When no signal voltage occurs, point 369 is typically at 0.3 volts. However, when movement of a person takes place within the sensor area, the voltage at point 369 will jump to 5 volts.

It will be understood that in this matter, the movement of a person into the sensor field causes a pulse to be produced by the infrared sensor 346. Through the circuitry, this pulse is amplified, if conditions are correct, to produce a valid talk signal of approximately 5 volts at either of points 369 or 371, depending on whether a "right approach" is made to the sensor or "left approach" is made to the sensor. This 5 volt signal is then transferred to the electrical circuitry 198 (discussed above) to cause the circuitry to activate a talker sequence as described above.

C. The Operation of the Device.

The operation of the device 10 can best be described with reference to FIG. 10, which shows a flow chart of the operation of the device.

It is assumed that the device 10 is in an unplugged mode when the operation begins. The first step to be taken is that the device 10 is plugged in to an AC receptacle. This causes the device 10 to go into a "system power-up" mode. When appropriate power has been achieved, the controller 200 performs a "power on test," to ensure that all of the components of the device 10 are working. The device 10 then goes into the "system standby" mode. When in the system standby mode, the sensor 37 seeks to detect the presence of a person in the vicinity of the device 10. The operation by which the sensor 37 makes this detection is described above. If the sensor 37 detects that a person is present, the sensor 37 sends a signal to the controller 200. The controller 200 then sends a signal to turn on a first light, such as the light 150 attached to socket 214. This causes the first visual display 26 to become lit.

After a short delay, an audio message segment begins playing. The first of the "N" audio segments will be played until such time as the audio storage chip 222 completes the first audio segment. When the first audio segment is completed, the audio storage chip 222 sends a signal to the controller 200 to notify the controller 200 that the first audio segment is completed. If the audio segment just completed is not the terminal audio segment (in this case, the sixth audio segment), the controller 200 will cause a second lamp, such as the lamp contained within the third socket 218 to be lit, thereby illuminating another (here, the third) visual display 30.

After the third visual display 30 is lit through the activation of a lamp, and after a suitable delay, the controller 200 sends a signal to the audio storage chip 222 to begin playing the second audio segment. The second audio segment then plays until it is complete, whereupon a signal is sent to the controller 200 signaling the completion of the second audio segment. This basic cycle continues on indefinitely until the final or "Nth" audio segment is played. In the flow chart shown in FIG. 11, the sixth audio segment is the final audio segment. When the sixth audio segment sends a signal to the controller that it has finished playing, the controller 200 is actuated to return the device to its standby mode, where it awaits a signal from the sensor 37 that a person is within the vicinity of the device. During such time as the audio segments are playing, and until their completion, the device goes out of its standby mode. When the device is not in its standby mode, it ignores signals from the sensor 37 that people are within the vicinity of the device 10. However, when back in the standby mode, the presence of a person within the vicinity of the device 10 will once again cause the device 10 to actuate, to once again cause the first lamp to turn on, and the audio storage chip 222 to begin playing the first audio segment.

D. The Software

An example of software for controlling the operation of the controller chip 200 and hence the device 10 is attached to the application as Appendix A.

Before beginning a detailed description of the code, there are several important aspects of the software which should be discussed. First, the first column of numbers in the program listing are line numbers assigned at the time of compiling. These line numbers will be referred to in the detailed description presented herein. Immediately following the line numbers, some of the program lines will have an equal sign (=) followed by a short sequence of hexadecimal digits. These lines are known as equate lines and tell the PIC200 which I/O lines (pins) correspond to which variables. The equate lines also tell the controller 200 which internal registers correspond to which variables. Program lines that do not have an equal sign before the hexadecimal digits are known as execute lines. The hex digits are the machine code for the instructions which follow on the line. Of course, the function of the compiler is to take the alpha program instructions, which are understandable by humans, and change them to hexadecimal machine code, which is understandable by the controller 200. Machine code instructions are listed here as a means of checking the compiler operation. The next three fields (columns) on the instruction line are reserved for the listing of the alpha program code. It is this code which is written by the designer of the program as a means of instructing the controller 200 to accomplish certain tasks. The next field used on the instruction line may be a comment. A comment is noted by a semicolon (";"), and it may also be placed on a line by itself. A comment is used only for readability purposes by humans and is ignored by the compiler. Note that the compiler does not provide machine code instructions for comment lines.

In the following description, reference numerals relate to the lines of code attached in Appendix A, and not to the various parts of the device 10 which may be labeled by similar reference numerals.

With the above general instructions in mind for understanding the program, the software can be described as below:

Lines 1–9 are header comments which are placed in the listing by the programmer.

Lines 10–13 define the pins on the controller 200 which may have been set up as input lines. PIC controllers, such as controller 200, are designed in a manner that any input/output line may be defined as either an input or an output when a program is run. Lines 16–22 define certain pins on the controller 200 as outputs.

Lines 27 and 28 define two locations within the controller 200 to be used as registers. In this case, the registers are defined as "DelayA" and "DelayB." Registers are internal locations where numbers are stored. These numbers can represents "counts" or events detected by the controller 200. In this particular case, the numbers in the registers are used for time delay purposes. It should be noted that lines 27 and 28 just describe the location of registers DelayA and DelayB within the controller 200. They do not define the initial numbers stored in the registers.

Lines 32–57 define subroutines used by the main program. Subroutines are defined at short sections of program code used repeatedly in any given code application. The five subroutines defined in this application are "setports," "clearegs," "clrlites," and "delay," and "delay2." The "setports" routine (lines 32–34) enable certain input/output pins on the controller 200 to serve as either inputs or outputs, as so desired by the programmer.

The "clearegs" routine described in lines 36–38 clears the controller 200 registers and sets them to zero. The "clrlites" routine described in lines 40–45 shuts off all display lights, when appropriate, at the end of the entire audio message after the last audio segment, at which point the lights are shut off. The "delay" routine described in lines 47–51 is called whenever it is necessary to introduce a time delay in the program execution. The Delay2 described in lines 53–57 is similar to the "delay" routine described above except that the time delay induced by the Delay2 routine is for a longer time period (60h) instead of 6h as with the delay routine.

Line 61 informs the program of the type of controller device 200 used in the circuit. Specifically, one embodiment of the present invention uses a 16C56PIC,RC oscillator "watchdog" timer off and code protect feature off. The "reset" address is defined in line 65. This is the location that the controller 200 "jumps to" whenever it receives a hardware reset signal.

Lines 69–74 mark the start of the main executable program code. These lines properly define the start-up conditions for the controller 200. In this application, line 69 starts the "setports" routine, line 70 calls the "clrlites" routine, and lines 71–74 set the PDC line 430 low (0 volts) and take it high momentarily (+5V) for the duration of the delay routine in line 73. In line 74, the PDC line is again taken low. Taking the PDC line 430 high like this resets the talker chip 222 to the first recorded audio segment.

The main control loop for this program is defined in lines 78–149. It is this part of the program that is processed continually while the controller 200 is running. Line 78 calls the "setports" routine, in a manner similar to line 69 of the program. Since lines 78–149 are the main control loop for the program, the controller 200 ports are initialized each time through the control loop. Line 79 sets the power down current line at point 430 (FIG. 9B) input high to the audio storage chip 222. This keeps the audio storage chip 222 in the "power down" mode, thus preventing the audio storage chip 222 from rendering a message to the listener. Line 80 shuts the lights 150 off. Lines 81 and 82 dear PIC resistors DelayA and DelayB.

Line 83 monitors the input from the system sensor board. When a person enters the area in which the sensor can sense the presence of the person, the input from the sensor circuit 343 (point 340 of FIG. 10) sends a signal to point 422 of the electrical circuit 198 (FIG. 9A), causing point 422 to go from 0 to +5 volts. When the controller 200 scans the program line, it jumps to the "PCdelay" location (line 88) if point 422 is high. If the first sensor input 422 is low the program continues its execution and continues onward line 84. Software line 84 examines the second sensor input line 420 and the controller, and the controller 200 jumps to "PCdelay" location if the second sensor input line at 420 is high. Second sensor input line 420 is usually used with a manual input for the device, if a manual "play activation" switch is used in lieu of the infrared sensor circuit 343. If neither the first sensor input line 422, or the second sensor input line 422 is high, the program execution continues onward to line 85.

Line 85 instructs the controller to make a jump to the "endloop" location. Thus, if the device does not detect a person in its sensor area, or if there is no manual input to manually start the display, the controller 200 makes a jump to the "Endloop" location. However, if either the first sensor input line 422, or the second sensor input line 420 is high, the controller will make a jump, and continue execution at the "PCdelay" location, which is line 88 of the software. Software line 88 causes one to be added (INC Command) to the value currently in the DelayA register. Line 89 examines the DelayA register to see if its content equals 2. If the DelayA register does not contain 2, the controller 200 jumps back to the "PCdelay" input location at software line 88. As noted before, this line increments the DelayA registered by 1. Eventually the value of the DelayA register reaches 2 in software line 89 and allows the controller 200 to "fall through" to software line 90.

Software lines 90 and 91 instruct the controller 200 to jump to the "Stalk" location, when the first sensor input line 422, or the second input sensor line 420 are high. This condition indicates that after waiting for the DelayA register to count up to the 2, there is still a signal present at either the first sensor input 422 or the second sensor input line 420. This would be considered by the device to be a legitimate "talk" command. If both the first and second sensor input lines 422, 420 are low, this would be considered to be an invalid talk signal in software lines 92 and 93, thereby instructing the controller 200 to jump to the "endloop" location. If either the first or second sensor input lines 422, 420 has caused the controller 200 to jump to the "stalk" location at software line 95, the system then starts to give its audio message. Software line 95 calls the delay subroutine and when the controller 200 has finished executing its subroutine code, the program execution continues at software line 96. Software line 96 forces the power down circuit (PDC) at point 430 of the electrical circuit at 198 (FIG. 9B) low. This causes the talker chip 222 to come out of its "sleep" (power save) mode. Line 98 calls subroutine "clrlites" and the controller 200 shuts off all lights. Line 99 then instructs the first light, lamp 214 (FIG. 9) to turn on.

Software lines 100 through 103 cause the talk signal to go low for a predetermined period of time. Software line 101 causes the talk signal to go low and to activate the talker chip 222. The signal stays low while the controller 200 executes the delay subroutine on line 102. When this delay subroutine has finished, software line 103 causes the talk signal to go high again. When the talk signal to the talker chip 222 goes low, it will play back the next recorded audio message segment. Since this is the first talk signal sequence after line 96 was executed, the first audio message segment will be played.

The controller 200 then waits in the line loop of software line 105, until the "end of message" (EOM) marker at the end of the first audio message arrives. When the EOM marker goes low at the message end, line 105 allows the controller 200 to "fall through" to the next program line at software line 107.

Program lines 107 through 115 turn off light 214 (FIG. 9B), turn on light 216, activate the second audio message segment and wait at line 115 for the arrival of the EOM marker at the end of the second audio message segment. Program code operation is similar to the detailed description for light 214 described above.

In a similar manner, lines 117 through 125 define program operation for light 218, and for the third audio message segment.

Program operation for light 220 (FIG. 9C) and the forth audio message segment is described in lines 127 through 143. Line 127 calls subroutine "clrlites" and shuts down all light outputs. The controller 200 then calls the delay subroutine line 128, and after completing the time delay "falls through" to software line 129. Software line 129 turns on light 220 (FIG. 9C). Lines 130 through 133 take the talk signal low for the duration of the delay subroutine at software line 132, and then back to high again at software line 133.

When the fourth audio message segment is playing, line 135 calls the "delay2" subroutine. When the Delay2 subroutine has finished, the forth audio message segment is also finished. Software line 136 then shuts off all lights. Line 137 resets the talker chip by taking the power down line 430 high while delay subroutine in line 138 runs. After line 138 has finished, line 139 sets the power down circuit at point 430 low again. This resets the audio message counter to the first audio message segment and puts the talker chip 220 "stand by" and "low current". It will be understood that the software described above places the talker chip in the standby mode after the playing of four audio segments, and is intended for use with a talker chip playing only four audio segments, such as the 20 second talker chip. If a six-segment talker chip (such as the 60 second talker chip) is used, the software would need to be expanded to accommodate the additional two audio segments before placing the talker chip 222 in the standby mode.

Line 140 sets the talk line high again, waiting for another valid "talk signal" from the actuating device. Lines 141–143 call Delay2 subroutine three times. Its accumulative delay time determines the total "lockout" time at the end of the message.

Lines 145 and 146 furnish a "trap" for the manual activation signal which can be inputted at point 420 if the manual activation is used in lieu of the sensor circuit. If someone is pressing the activation switch on the front panel of a manually actuated device the controller 200 will jump around the loop from line 145 and 146. When the second input line at 420 is released, software line 146 allows the controller 200 to "fall through" to line 148 (endloop).

With this feature, someone cannot hold manual activation switch down to keep the device in a continuous playback mode.

Software line 148 provides a "no operation" (NOP) instruction to the controller 200, and code execution continues over to software line 149. Software line 149 instructs the controller 200 to jump to the "ctrloop" location at line 78.

In this manner the controller continues to process program code while circulating continuously through the control loop provided by lines 78 through 149.

While the invention has been described with reference to certain detailed descriptions of preferred embodiments, it will be appreciated by those skilled in the art that the invention is not limited by the description contained herein, but rather by the claims appended hereto.

APPENDIX A
SOFTWARE OPERATION
Parallax PIC16C5x Assembler v2.0

```
1                ;File name: P0001003.SRC
2                ;Code file for Felknor Talker
3                ;20 second chip
4                ;Light sequence it: 0,1,2,3
5                ;Program rewritten for lower cost unit on 12/31/94
6                ;Program revision V1.0
7                ;Equates:
8
9                ;Inputs:
10  =00C6        pc1          =    rb.6     ;P12=1 Pin 12 Photocel 1 input
11  =00E6        pc2          =    rb.7     ;P13=1 Pin 13 Manual switch input
12  =0025        EOM          =    ra.1     ;P18=0 Talker chip at EOM
13  =0045        OVF          =    ra.2     ;P1=0 Talker chip at end of capacity
14
```

-continued

APPENDIX A
SOFTWARE OPERATION
Parallax PIC16C5x Assembler v2.0

```
                    ;Outputs:
=0006               Lite0          =   rb.0     ;P6=1 Lite 0 on
=0026               Lite1          =   rb.1     ;P7=1 Lite 1 on
=0046               Talk           =   rb.2     ;P8=0 Start Talking
=0066               Lite2          =   rb.3     :P9=1 Lite 2 on
=0086               Aux1           =   rb.4     ;Auxilary output 1
=00A6               Lite3          =   rb.5     ;P11=1 Lite 3 on
=0005               PDC            =   ra.0     ;P17=1 Power Down cycle - talker chip
                                                ;is held off when this signal is high
=0065               Lite4          =   ra.3     ;P2=1 Lite 4 on

                    ;Registers:
=0008               DelayA         =   08h      ;Delay register A
=0009               DelayB         =   09h      ;Delay register B

                    ;Subroutines;

000-C06 005         setports                    mov  IRA,#0110b       ;Port A bits 2 & 1 inputs
002-CC0 006                                     mov  IRB,#11000000b   ;Port B bits 7 & 6 inputs
004-800

005-068             Clearegs                    clr  DelayA
006-069                                         clr  DelayB
007-800                                         ret

008-406             clr-                        clrb Lite0
                    lites
009-426                                         clrb Lite1
00A-466                                         clrb Lite2
00B-4A6                                         clrb Lite3
00C-465                                         clrb Lite4
00D-800                                         ret

00E-068             delay                       clr  DelayA
00F-2A8             :del1                       lnc  DelayA
010-C06 088 743 A0f                             cjne DelayA,#06h,:del1
014-068                                         clr  DelayA
015-800                                         ret

016-068             delay2                      clr  DelayA
017-2A8                 :del2                       lnc  DelayA
018-C60 088 743 A17                                 cjne DelayA,#60h,:del2
01C-068                                             clr  DelayA
01D-800                                             ret

                    ;Setup device for PIC16C56-RC

01E-                device plc16c56,rc_osc,wdt_off,protect_off

                    ;Reset address;

3FF-A1E                 reset    start

                    ;Initial values:

01E-900                 start                   call setports
01F-908                                         call clrlites
020-405                                         clrb PDC
021-505                                         setb PDC
022-90E                                         call delay
023-405                                         clrb PDC
7
                    ;Main control loop:

024-900                 ctrloop call                 setports          ;Define ports
025-505                                         setb PDC               ;Hold system off
026-908                                         call clrlites          ;Shut lites off
027-068                                         clr  DelayA
028-069                                         clr  DelayB
029-6C6 A2F                                     jb   pc1,pcdelay       ;PC1 input start time
02B-6E6 A2F                                     jb   pc2,pcdelay       ;PC2 input start time
02D-A69                                         jmp  endloop
02E-A69                                         jmp  endloop

02F-2A8                 pcdelay                 lnc  DelayA
030-C02 088 743 A2F                             cjne DealyA,#02h,pcdelay ;IR sensor delay time
```

-continued

APPENDIX A
SOFTWARE OPERATION
Parallax PIC16C5x Assembler v2.0

```
 90  034-6C6 A3A                    jb      pc1,stalk       ;PC1 input still there
 91  036-6E6 A3A                    jb      pc2,stalk       ;PC2 input still there
 92  038-A69                        jmp     endloop
 93  039-A69                        jmp     endloop
 94
 95  03A-90E          stalk         call    delay
 96  03B-405                        clrb    PDC             ;Turn system on
 97
 98  03C-908                        call    clrlites
 99  03D-506                        setb    Lite0
100  03E-546                        setb    Talk
101  03F-446                        clrb    Talk            ;start talking signal
102  040-90E                        call    delay
103  041-546                        setb    Talk
104
105  042-625 A42 EOM1               jb      EOM,EOM1
106
107  044-908          EOM1A         call    clrlites        ;Turn off lamps
108  045-90E                        call    delay
109  046-526                        setb    Lite1
110  047-546                        setb    Talk
111  048-446                        clrb    Talk    ;       Start talking signal
112  049-90E                        call    delay
113  04A-546                        setb    Talk
114
115  04B-625 A4B EOM2               jb      EOM,EOM2
116
117  04D-908          EOM2A         call    clrlites        ;Turn off lamps
118  04E-90E                        call    delay
119  04F-566                        setb    Lite2
120  050-546                        setb    Talk
121  051-446                        clrb    Talk            ;Start talking signal
122  052-90E                        call    delay
123  053-546                        setb    Talk
124
125  054-625 A54 EOM3               jb      EOM,EOM3
126
127  056-908          EOM3A         call    clrlites        ;Turn off lamps
128  057-90E                        call    delay
129  058-5A6                        setb    Lite3
130  059-546                        setb    Talk
131  05A-446                        clrb    Talk            ;start talking signal
132  05B-90E                        call    delay
133  05C-546                        setb    Talk
134
135  05D-916          endel5        call    delay2
136  05E-908                        call    clrlites
137  05F-505                        setb    PDC
138  060-90E                        call    delay
139  061-405                        clrb    PDC
140  062-546                        setb    Talk
141  063-916                        call    delay2
142  064-916                        call    delay2
143  065-916                        call    delay2
144
145  055-908          mantrap       call    clrlites
146  067-6E6 A66                    jb      PC2,mantrap
147
148  069-000          endloop       nop
149  06A-A24                        jmp     ctrloop         ;To loop beginning
32931.dl final version
```

What is claimed is:

1. An electronic display device for rendering both an audio message and a visual message, the display device comprising:

a. a housing means, including a flame means for positioning at least a first and second generally non-overlapping transparencies that contain a visual message;

b. a first light source for illuminating the first transparency;

c. a second light source for illuminating the second transparency;

d. a direct analog audio storage chip for playing an audio message having at least a first audio segment and a second audio segment;

e. a sensor means for detecting the presence of a person in the vicinity of the device; and f. a controller means for controlling the operation of the first and second light sources, the direct analog audio storage chip, and the sensor means the controller means including means for:

(1). receiving a signal from the sensor means in response to the sensing, by the sensor means, of a person in the vicinity of the device;

(2). actuating both of:

I. the first light source to begin illuminating the first transparency; and ii. the audio storage chip to begin playback of the first audio segment, in response to the reception of the signal from the sensor means;

(3). receiving an end-of-segment signal from the audio storage chip indicating the end of the first audio segment;

(4). deactivating both of:

I. the first light source to stop illuminating the first transparency; and ii. the audio storage chip to stop playback of the first audio segment, in response to the reception of the end-of-segment signal from the audio storage chip; and (5). atuating both of:

I. the second light source to begin illuminating the second transparency; and ii. the audio storage chip to begin playback of the second audio segment; in response to the deactivation of the first light source and the first audio segment of the audio storage chip.

2. The device of claim 1, wherein the controller means includes means for ignoring the signal from the sensor means during the operation of the audio storage chip.

3. The device of claim 2, wherein the controller means includes means for receiving an end-of-segment signal at the end of one of the at least first and second audio segments and for placing the device in a stand-by state of readiness for awaiting another signal from the sensor means indicating the presence of a person in the vicinity of the device.

4. The device of claim 1 wherein the controller means includes means for:

a. receiving a signal from the audio storage chip indicating the end of the second audio segment;

b. deactivating both of:

I. the second light source to stop illuminating the second transparency; and ii. the audio storage chip to stop playback of the second audio segment; and c. placing the device in a stand-by state of readiness for awaiting another signal from the sensor means indicating the presence of a person in the vicinity of the device.

5. The device of claim 1 wherein the direct analog audio storage chip has at least a number, N, of audio segments, wherein N is at least four audio segments, and the controller means includes means for:

a. receiving an end-of-segment signal from the audio storage chip indicating the end of the Nth audio segment;

b. deactivating both of:

I. the light source then illuminated; and ii. the audio storage chip to stop playback of the Nth audio segment; and c. placing the device in a stand-by state of readiness for awaiting another signal from the sensor means indicating the presence of a person in the vicinity of the device.

6. The device of claim 5, wherein the number T, of transparencies is different than the number, N, of audio segments, and the controller means include means for actuating at least two light sources to illuminate at least two transparencies in response to reception of a signal from the audio storage chip.

7. The device of claim 6, wherein the controller means includes means for ignoring the signal from the sensor means during the operation of the audio storage chip.

8. The device of claim 1 wherein the controller means includes delay means for inducing a delay between the actuation of the at least one of the first and second light sources to begin illuminating their respective transparencies, and the actuation of the audio storage chip to begin playback of the respective first and second audio segments.

9. The device of claim 1 wherein:

a. the audio storage chip includes a record mode wherein audio segments can be recorded, and a playback made wherein recorded segments can be played back;

b. the controller means includes means for determining whether the audio storage chip is in its playback mode before commencing playback of the first audio segment; and c. the means for detecting the presence of a person in the vicinity of the device comprises a user-actuable actuating means.

10. The device of claim 1 wherein the controller means includes means for sending a relatively higher voltage signal to the audio storage chip during the playback of the audio segments, to maintain the operation of the audio storage chip throughout the duration of the audio segment.

11. The device of claim 1 wherein the controller means includes means for determining the existence of a relatively higher voltage condition from the sensor means in response to the detection by the sensor means of a person in the vicinity of the device.

12. The device of claim 1 wherein the housing includes:

a. a front panel member, having a viewing aperture for receiving the frame means;

b. a real panel member; and c. fastening means for fastening together the front panel member and rear panel member and sandwiching the frame means between the front and rear panel members.

13. The device of claim 12, wherein each of the front panel member and rear panel member include a plurality of aligned, spaced peripheral apertures through which the fastening means can pass for fastening together the front panel member, the rear panel member to sandwich the frame means therebetween.

14. An electronic display device for rendering both an audio message and a visual message, the display device comprising:

a. a housing means, including a frame means for positioning at least a first and second generally non-overlapping transparencies that contain a visual message;

b. a first light source for illuminating the first transparency;

c. a second light source for illuminating the second transparency;

d. a direct analog audio storage chip for playing an audio message having at least a first audio segment and a second audio segment;

e. a sensor means for detecting the presence of a person in the vicinity of the device; and f. a controller means for controlling the operation of the first and second light sources, the direct analog audio storage chip, and the sensor means the controller means including means for:

(1). receiving a signal from the sensor means in response to the sensing, by the sensor means, of a person in the vicinity of the device;

(2) actuating, in a sequential manner,

I. the first light source to begin illuminating the first transparency and the audio storage chip to begin playback of the first audio segment in response to the reception of the signal from the sensor means; and ii. the second light source to begin illuminating the second transparency and the audio storage chip to begin playback of the second audio segment.

15. An electronic display device for rendering both an audio message and a visual message, the display device comprising:

1. a housing means, including a frame means for positioning at least a first and second generally non-overlapping transparencies that contain a visual message;
2. a first light source for illuminating the first transparency;
3. a second light source for illuminating the second transparency;
4. a direct analog audio storage chip for playing an audio message having at least a first audio segment and a second audio segment;
5. a sensor means for detecting the presence of a person in the vicinity of the device; and
6. a controller means for controlling the operation of the first and second light sources, the direct analog audio storage chip, and the sensor means, wherein the housing means includes:

a. a front panel member having a viewing aperture alignable with the transparencies of the frame means, and a plurality of spaced peripheral apertures, and means for receiving the frame means; and b. a rear panel member; and c. the frame means is sized to be received by the front panel member, further comprising a plurality of fastening means for passing through the spaced peripheral apertures of the front panel member for fastening together the front panel member and the rear panel member to sandwich the frame means thereunder.

16. The device of claim 15, wherein the frame means comprises:

a. a first generally transparent shield member;

b. a transparency member capable of containing at least two co-planar, non-overlapping transparencies; and c. a diffusion member for diffusing light passing through the frame means.

17. The device of claim 15, wherein the front panel member includes a grill means through which sound can pass and the first transparent shield member comprises a tinted acrylic member for obscuring the transparencies when the first light source is unlit, but permitting the first transparency to be viewed when the first light source is lit, further comprising an audio transducer means disposed adjacent to the grill portion.

18. The device of claim 17, further comprising a mounting bracket means mounted to, and interiorly of the back panel member, the mounting bracket means for receiving and mounting the at least two light sources, the mounting bracket means including a circuit board of the controller means.

19. The device of claim 18, further comprising a reflector panel member sandwiched by the front and rear panel between the front panel and the frame means for aiding in the transfer of light from the at least two light sources to the at least two transparencies.

20. The device of claim 19, wherein the reflector panel member includes at least one cavity for each of the at least two light sources, and wherein the frame means, the at least two transparencies, and the reflector panel member are configured to confine the light from each of the at least two light sources to the area within the respective cavity and through the respective transparency.

21. The device of claim 20 wherein the means for detecting the presence of a person comprises a sensor means including a sensor bezel and a sensor board, the sensor bezel being mounted to the sensor board, and the sensor board being mounted to the reflector member.

22. An electronic display device for rendering both an audio message and a visual message, the display device comprising:

a. a frame means for positioning at least a first and second generally non-overlapping transparencies that contain a visual message, the frame means comprising a first generally transparent shield member, a transparency member capable of containing the at least two co-planar, non-overlapping transparencies; and a diffusion member for diffusing light passing through the frame means;

b. a housing means for housing device components, the housing means including (1) a front panel member having a viewing aperture alignable with the transparencies of the frame means, and a plurality of spaced peripheral apertures, and means for receiving the frame means; and (2) a back panel member having a plurality of spaced peripheral apertures, the apertures being alignable with the apertures of the front panel member, and through which the fastening means can pass for fastening together the front panel member and real panel member to sandwich the frame means therebetween c. a first light source for illuminating the first transparency;

d. a second light source for illuminating the second transparency;

e. a reflector panel member disposed between the diffusion panel and the rear panel member for aiding in the transfer of light from the first and second light sources to the at least two transparencies, the reflector panel member including at least two cavities, one for each of the first and second light sources;

f. an audio message delivery means for playing an audio message having at least a first audio segment and a second audio segment; and g. a controller means for controlling the operation of the first and second light sources, and the audio message delivery means.

23. The device of claim 22, wherein the audio message delivery means comprises a direct analog audio storage chip, and the frame means, the at least two transparencies, and the reflector panel member are configured to confine the light from each of the first and second light sources to the area within the respective cavity and through the respective transparency.

* * * * *